US006526238B2

(12) United States Patent
Kin et al.

(10) Patent No.: US 6,526,238 B2
(45) Date of Patent: Feb. 25, 2003

(54) DEVELOPING DEVICE

(75) Inventors: Hidenori Kin, Nagano-Ken (JP); Takehiko Okamura, Nagano-Ken (JP); Yoshiro Koga, Nagano-Ken (JP); Fumio Takagi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/853,656

(22) Filed: May 14, 2001

(65) Prior Publication Data

US 2002/0009304 A1 Jan. 24, 2002

(30) Foreign Application Priority Data

| | | |
|---|---|---|
| May 31, 2000 | (JP) | 2000-161303 |
| May 31, 2000 | (JP) | 2000-161304 |
| May 31, 2000 | (JP) | 2000-161305 |
| May 31, 2000 | (JP) | 2000-161306 |
| May 31, 2000 | (JP) | 2000-161307 |
| May 12, 2000 | (JP) | 2000-140354 |
| Jun. 7, 2000 | (JP) | 2000-170108 |

(51) Int. Cl.[7] ..... G03G 15/08
(52) U.S. Cl. ..... 399/55; 399/281; 399/285
(58) Field of Search ..... 399/53, 55, 28, 399/284, 285

(56) References Cited

U.S. PATENT DOCUMENTS

| | | | | |
|---|---|---|---|---|
| 5,044,310 A | * | 9/1991 | Kanbe et al. | 399/281 |
| 5,239,344 A | * | 8/1993 | Enoki et al. | 399/285 |
| 5,307,127 A | * | 4/1994 | Kobayashi et al. | 399/285 X |
| 5,309,206 A | * | 5/1994 | Deishi et al. | 399/285 X |
| 5,937,228 A | * | 8/1999 | Shoji et al. | 399/55 |
| 2001/0055503 A1 | * | 12/2001 | Kin et al. | 399/284 |

FOREIGN PATENT DOCUMENTS

| | | |
|---|---|---|
| JP | 58-32375 | 7/1983 |
| JP | 2000-122388 | 4/2000 |

* cited by examiner

*Primary Examiner*—Sophia S. Chen
(74) *Attorney, Agent, or Firm*—Sughrue Mion, PLLC

(57) ABSTRACT

A developing device includes a supply member disposed to rotate in contact with a developer carrier to supply developer layer having a predetermined thickness to the developer carrier surface. A layer forming member is disposed to abut against the developer carrier to regulate the layer thickness of the developer so as to form a thin developer layer on the developer carrier. A bias application unit applies an AC-superimposed bias voltage to the developer carrier. A latent image on a latent image carrier is developed with the thin developer layer formed on the developer carrier by the layer forming member. The minimum value of the AC-superimposed bias voltage may be lower than the exposure potential of the latent image carrier, and a maximum value of the bias voltage is to be lower then the charge potential. However, the polarities of the two voltages may be identical.

16 Claims, 19 Drawing Sheets

FIG. 14

| No. | Developing bias conditions | | | | Background fogging (solid white) | Longitudinal stripe (40% halftone) | Lateral stripe (40% halftone) | Gradation (γ value) | Roughness (40% halftone) |
|---|---|---|---|---|---|---|---|---|---|
| | AC waveform | f(Hz) | Vpp(v) | Vdc(v) | | | | | |
| Example ① | Rectangular wave | 2000 | 400 | -300 | ○ | ◎ | ○ | ◎ | ◎ |
| Example ② | ↑ | ↑ | 50 | -300 | ○ | △ | △ | △ | △ |
| Example ③ | ↑ | ↑ | 100 | -300 | ○ | ○ | ○ | ○ | ○ |
| Example ④ | ↑ | ↑ | 600 | -300 | ○ | ◎ | ○ | ◎ | ◎ |
| Example ⑤ | ↑ | ↑ | 500 | -200 | ○ | ○ | ○ | ○ | ○ |
| Example ⑥ | ↑ | 300 | 400 | -300 | ○ | ◎ | △ | ◎ | ◎ |
| Example ⑦ | ↑ | 700 | 400 | -300 | ○ | ◎ | ○ | ◎ | ◎ |
| Example ⑧ | ↑ | 5000 | 400 | -300 | ○ | ○ | ○ | △ | △ |
| Example ⑨ | ↑ | 10000 | 400 | -300 | ○ | △ | ○ | △ | △ |
| Example ⑩ | Triangular wave | 2000 | 400 | -300 | ○ | ◎ | ○ | ○ | ○ |
| Example ⑪ | Sine wave | 2000 | 400 | -300 | ○ | ◎ | ○ | ○ | ○ |
| Comparative example ① | Rectangular wave | 2000 | 400 | -500 | × | △ | △ | △ | × |
| Comparative example ② | Rectangular wave | 2000 | 800 | -300 | ×× | △ | △ | △ | × |
| Comparative example ③ | DC | — | — | -300 | ○ | × | × | × | ×× |

◎: Very good ○: Good △: Tolerable ×: Bad ××: Very bad

FIG. 15

| No. | Developing bias conditions | | | | Background fogging (solid white) | Fogging (solid white) | Longitudinal stripe (40% halftone) | Lateral stripe (40% halftone) | Gradation (γ value) | Roughness (40% halftone) |
|---|---|---|---|---|---|---|---|---|---|---|
| | AC waveform | f(Hz) | Vpp(v) | Vdc(v) | | | | | | |
| Example ① | Rectangular wave | 2000 | 400 | -300 | ○ | ○ | ◎ | ○ | ◎ | ◎ |
| Example ② | ↑ | ↑ | 50 | -300 | ○ | ○ | △ | △ | △ | △ |
| Example ③ | ↑ | ↑ | 100 | -300 | ○ | ○ | ○ | ○ | ○ | ○ |
| Example ④ | ↑ | ↑ | 600 | -300 | ○ | ○ | ◎ | ○ | ◎ | ◎ |
| Example ⑤ | ↑ | ↑ | 500 | -300 | ○ | ○ | ◎ | ○ | ◎ | ◎ |
| Example ⑥ | ↑ | 300 | 400 | -300 | ○ | ○ | ◎ | △ | ◎ | ◎ |
| Example ⑦ | ↑ | 700 | 400 | -300 | ○ | ○ | ◎ | ○ | ◎ | ◎ |
| Example ⑧ | ↑ | 5000 | 400 | -300 | ○ | ○ | ○ | ○ | △ | △ |
| Example ⑨ | ↑ | 10000 | 400 | -300 | ○ | ○ | △ | ○ | △ | △ |
| Example ⑩ | Triangular wave | 2000 | 400 | -300 | ○ | ○ | ◎ | ○ | ○ | ○ |
| Example ⑪ | Sine wave | 2000 | 400 | -300 | ○ | ○ | ◎ | ○ | ○ | ○ |
| Comparative example ① | Rectangular wave | 2000 | 600 | -200 | × (latent image destroyed) | – | – | – | – | – |
| Comparative example ② | Rectangular wave | 2000 | 450 | -200 | ○ | × | △ | △ | △ | ○ |
| Comparative example ③ | DC | — | — | -300 | ○ | △ | × | × | × | ×× |

◎: Very good ○: Good △: Tolerable ×: Bad ××: Very bad

FIG. 16

| No. | Developing bias conditions | | | | Background fogging (solid white) | Fogging (solid white) | Longitudinal stripe (40% halftone) | Lateral stripe (40% halftone) | Gradation (γ value) | Roughness (40% halftone) |
|---|---|---|---|---|---|---|---|---|---|---|
| | AC waveform | f(Hz) | Vpp(v) | Vdc(v) | | | | | | |
| Example ① | Rectangular wave | 2000 | 400 | -300 | ○ | ○ | ◎ | ○ | ◎ | ◎ |
| Example ② | ↑ | ↑ | 50 | -300 | ○ | ○ | △ | △ | △ | △ |
| Example ③ | ↑ | ↑ | 100 | -300 | ○ | ○ | ○ | ○ | ○ | ○ |
| Example ④ | ↑ | ↑ | 600 | -300 | ○ | ○ | ◎ | ○ | ◎ | ◎ |
| Example ⑤ | ↑ | ↑ | 400 | -200 | ○ | ○ | ○ | ○ | ○ | ○ |
| Example ⑥ | ↑ | 300 | 400 | -300 | ○ | ○ | ◎ | △ | ◎ | ◎ |
| Example ⑦ | ↑ | 700 | 400 | -300 | ○ | ○ | ◎ | ○ | ◎ | ◎ |
| Example ⑧ | ↑ | 5000 | 400 | -300 | ○ | ○ | ○ | ○ | △ | △ |
| Example ⑨ | ↑ | 10000 | 400 | -300 | ○ | ○ | △ | ○ | △ | △ |
| Example ⑩ | Triangular wave | 2000 | 400 | -300 | ○ | ○ | ◎ | ○ | ○ | ○ |
| Example ⑪ | Sine wave | 2000 | 400 | -300 | ○ | ○ | ◎ | ○ | ○ | ○ |
| Comparative example ① | Rectangular wave | 2000 | 400 | -500 | × | ○ | △ | △ | △ | × |
| Comparative example ② | Rectangular wave | 2000 | 600 | -200 | × (latent image destroyed) | – | – | – | – | – |
| Comparative example ③ | Rectangular wave | 2000 | 450 | -200 | ○ | × | △ | △ | △ | ○ |
| Comparative example ④ | DC | — | — | -300 | ○ | △ | × | × | × | ×× |

◎: Very good ○: Good △: Tolerable ×: Bad ××: Very bad

FIG. 17

| No. | Developing bias conditions | | | | Background fogging (solid white) | Longitudinal stripe (40% halftone) | Lateral stripe (40% halftone) | Gradation (γ value) | Roughness (40% halftone) |
|---|---|---|---|---|---|---|---|---|---|
| | AC waveform | f(Hz) | Vpp(v) | Vdc(v) | | | | | |
| Example ① | Rectangular wave | 2000 | 400 | -300 | ○ | ◎ | ○ | ◎ | ◎ |
| Example ② | ↑ | ↑ | 50 | -300 | ○ | △ | △ | △ | △ |
| Example ③ | ↑ | ↑ | 100 | -300 | ○ | ○ | ○ | ○ | ○ |
| Example ④ | ↑ | ↑ | 570 | -300 | ○ | ◎ | ○ | ◎ | ◎ |
| Example ⑤ | ↑ | ↑ | 500 | -200 | ○ | ○ | ○ | ○ | ○ |
| Example ⑥ | ↑ | 300 | 400 | -300 | ○ | ◎ | △ | ◎ | ◎ |
| Example ⑦ | ↑ | 700 | 400 | -300 | ○ | ◎ | ○ | ◎ | ◎ |
| Example ⑧ | ↑ | 5000 | 400 | -300 | ○ | ○ | ○ | △ | △ |
| Example ⑨ | ↑ | 10000 | 400 | -300 | ○ | △ | ○ | △ | △ |
| Example ⑩ | Triangular wave | 2000 | 400 | -300 | ○ | ◎ | ○ | ○ | ○ |
| Example ⑪ | Sine wave | 2000 | 400 | -300 | ○ | ◎ | ○ | ○ | ○ |
| Comparative example① | Rectangular wave | 2000 | 700 | -300 | ×× | △ | △ | △ | × |
| Comparative example② | Rectangular wave | 2000 | 570 | -350 | × | △ | △ | △ | × |
| Comparative example③ | DC | — | — | -300 | ○ | × | × | × | ×× |

◎: Very good ○: Good △: Tolerable ×: Bad ××: Very bad

DEVELOPING DEVICE

BACKGROUND OF THE INVENTION

1. Field of the Invention

The present invention relates to a developing device for developing a latent image on a latent image carrier with a thin developer layer formed on a developer carrier by a layer forming member under application of an AC-superimposed bias voltage to the developer carrier, the AC-superimposed bias voltage being formed by superimposing an alternating current on a DC bias voltage.

2. Discussion of Related Art

Conventionally, developing devices are arranged to apply a DC bias voltage to a developer carrier to form a thin layer of a developer on the developer carrier by a layer forming member and to allow the developer to move and adhere to an image area on a latent image carrier. In one type of conventional developing devices, an alternating current is superimposed on the DC bias voltage in order to vibrate the developer and to thereby facilitate the movement of the developer from the developer carrier to the image area on the latent image carrier (for example, see Japanese Patent Application Post-Exam Publication No. Sho 58-32375). This type of developing devices adopts the non-contact jumping development in which a gap is provided between the developer carrier and the latent image carrier, and the developer is caused to fly from the developer carrier to the image area on the latent image carrier. The amplitude ($V_{max}-V_{min}$) of the alternating current is, as shown in FIG. 1, set to a value exceeding the width between the non-image area potential $V_0$ and image area potential $V_{on}$ of the latent image carrier. The reason for this is that the threshold value of the bias voltage sufficient to allow the developer to adhere to the image area on the latent image carrier is higher than the electric potential at the non-image area, and conversely, the threshold value of the bias voltage sufficient to separate the developer adhering to the non-image area is lower than the electric potential at the image area on the latent image carrier.

Meanwhile, a developing device has been proposed in which an AC-superimposed bias voltage is applied to a developing member provided in opposing relation to a latent image retaining member, and a constant-voltage bias is applied to a developer conveying member for conveying a developer to the developing member, thereby forming an electric potential gradient between the two members to supply the developer (for example, see Japanese Patent Application Post-Exam Publication No. Hei 3-21906). There has also been proposed another type of developing device in which a constant-voltage bias is applied to a developer carrier provided in opposing relation to a latent image carrier, and a constant-current bias is applied to a toner supply member placed in contact with the developer carrier, thereby allowing a constant electric current to flow to the toner supply member from the developer carrier (for example, see Japanese Patent Application Unexamined Publication (KOKAI) Nos. Hei 9-106172 and Hei 10-104936).

The conventional developing devices suffer, however, from some problems as stated below. The developer adhering to the non-image area on the latent image carrier cannot sufficiently be separated. Accordingly, the developer is likely to adhere to the non-image area, causing fogging. Further, blur may occur in a halftone image owing to disconnection, thickening or scattering of thin lines of the image. This causes image quality degradation. In color image formation, in particular, if there occurs such fogging or blur due to disconnection, thickening or scattering of thin lines of the image, it becomes impossible to provide satisfactory colors in halftone because a color image is outputted in the form of a combination of various color materials superimposed on one another. To minimize these problems, high-precision control is required for the gap between the developer carrier and the latent image carrier.

Further, in a case where an AC-superimposed bias voltage is applied as a developing bias voltage, if the bias applied to the toner supply member is subjected to constant-voltage control, the electric potential cannot follow the alternating current of the developing bias voltage but acts as a constant potential at all times. Accordingly, the bias may become an inverted electric potential that acts in a direction in which the developer separates from the developer carrier toward the toner supply member. Alternatively, it may become impossible to provide the desired potential difference even if the bias does not act in the separating direction. Therefore, stable supply of toner cannot be ensured. As a result, undesired brush marks occur on the developer carrier, and toner deterioration occurs with time. In addition, the resistance between the developer carrier and the toner supply member changes with time, causing a delay in the supply of toner. This makes it impossible to obtain favorable images. If the supply voltage is increased, the required toner supply can be ensured, but the amount of toner conveyed becomes excessively large. Consequently, image defects such as stripes due to positive charge occur in the developed image. Further, fogging occurs in the developed image.

In contact development type developing devices, an electrically charged one-component developer is conveyed from a developer carrier to a latent image carrier placed in contact with the developer carrier to develop an electrostatic latent image on the latent image carrier with the one-component developer. In this case, a metal roller made of aluminum or iron-base material is used as the developer carrier. In particular, an aluminum roller is frequently used because it is easy to form by machining and less costly.

Incidentally, the developer carrier used in the developing device is demanded to have the functions of ① conveying the developer, ② electrically charging the developer, and ③ preventing discharge of the developing bias voltage.

To improve the developer conveying performance and the developer chargeability, a carrier roll (i.e. developer carrier) has heretofore been proposed in Japanese Patent Application Post-Exam Publication No. Hei 6-46331 in which the surface of a metal roller is sandblasted to form a dimpled surface, which is then subjected to metal plating treatment, e.g. nickel plating. With the carrier roll disclosed in the post-exam publication, the dimpled surface formed on the carrier roll allows the developer conveying capability to be enhanced mechanically. Thus, the developer conveying performance is improved. Moreover, the dimpled surface allows an increase in the area of contact with the developer and hence permits an improvement in the developer chargeability. Further, the wear resistance of the dimpled surface of the metal roller is improved by subjecting the dimpled surface to metal plating treatment.

To prevent discharge of the developing bias voltage, a developer carrier having a resistivity set to a predetermined value has heretofore been proposed. For example, Japanese Patent Application Post-Exam Publication No. Hei 2-26226 proposes a non-magnetic one-component toner carrier (i.e. developer carrier) comprising a cylindrical rigid member formed of a resin material with an electrically conductive powder dispersed therein and having a resistivity in the range of $10^4$ to $10^{12}$ Ωcm. The inner surface of the cylindrical rigid member is formed with an electrically conductive film or coated with an electrically conductive paint having a resistivity of not more than $10^7$ Ωcm. Japanese Gazette Containing the Patent No. 2705090 proposes a non-magnetic one-component toner carrier (i.e. developer carrier) having a semiconductive layer with a thickness of 100 to 1000 micrometers formed on the surface thereof by using a ceramic material, e.g. alumina, with a resistivity of $10^4$ to $10^{12}$ Ωcm. With the non-magnetic one-component toner carriers disclosed in these official gazettes, because at least the surface thereof has a predetermined resistivity, the discharge of the developing bias voltage can be effectively prevented. Thus, the occurrence of image defects can be prevented.

Meanwhile, as disclosed in Japanese Patent Application Post-Exam Publication No. Hei 2-26226 and Japanese Gazette Containing the Patent No. 2705090, the conventional developing devices use a developing bias voltage formed by superimposing an AC voltage on a DC voltage to prevent undesired toner adhesion to the non-image area on the latent image carrier (i.e. fogging) and, at the same time, to provide a moderate edge effect and to improve gradation characteristics.

In the carrier roll disclosed in Japanese Patent Application Post-Exam Publication No. Hei 6-46331, however, the sandblasted dimpled surface is subjected to metal plating treatment. The plating treatment causes the plating material to be overlaid on the dimpled surface. Consequently, the clear dimple configuration formed by the sandblasting treatment is deformed by the plating material. That is, projections on the dimpled surface, i.e. edges at the boundaries between adjacent recesses, are deformed. Consequently, the dimples become unclear. Therefore, even if clear dimples are formed by the sandblasting treatment to improve the dimpled surface in wear resistance, the dimples are made unclear by the metal plating. Accordingly, it becomes impossible to sufficiently and surely obtain the effects of the dimples formed on the developer carrier surface to improve the toner conveying performance and the toner chargeability.

The developer carrier disclosed in Japanese Patent Application Post-Exam Publication No. Hei 2-26226, which is formed of a resin material having an electrically conductive powder dispersed therein, involves the problem that because an electrically conductive powder is dispersed in the resin material, the developer carrier is likely to be affected by the dispersed condition of the powder. Therefore, it is difficult for the carrier surface to have a uniform resistance. Accordingly, density unevenness is likely to occur in the developed image.

The toner carrier disclosed in Japanese Gazette Containing the Patent No. 2705090, which is formed with a semiconductive layer of a ceramic material having a thickness of 100 to 1000 micrometers, suffers from the problem that the manufacture thereof is complicated and the costs are unfavorably high because the semiconductive layer is formed by spraying the base material of the toner carrier with ceramic particles melted by arc discharge.

Moreover, it is desired that the above-described three functions ① to ③ be imparted to the developer carrier even more surely. Therefore, it is conceivable to impart the three functions to the developer carrier by combining together the technical matters disclosed in the above-described official gazettes. However, the following problems arise when the techniques disclosed in the official gazettes are combined together to impart the three functions to the developer carrier.

That is, in combination of the techniques disclosed in Japanese Patent Application Post-Exam Publication Nos. Hei 6-46331 and Hei 2-26226, the carrier formed of a resin material having an electrically conductive powder dispersed therein as set forth in Japanese Patent Application Post-Exam Publication No. Hei 2-26226 is not a metallic carrier; therefore, it is difficult to form dimples by sandblasting treatment and to perform a treatment for improving the wear resistance of the dimpled surface as stated in Japanese Patent Application Post-Exam Publication No. Hei 6-46331. Accordingly, it is impossible to combine together the techniques disclosed in Japanese Patent Application Post-Exam Publication Nos. Hei 6-46331 and Hei 2-26226. It is extremely difficult to impart the above-described three functions to the developer carrier even more surely.

In combination of the techniques disclosed in Japanese Patent Application Post-Exam Publication No. Hei 6-46331 and Japanese Gazette Containing the Patent No. 2705090, a semiconductive layer of a ceramic material melted by arc discharge as stated in Japanese Gazette Containing the Patent No. 2705090 is formed on a dimpled surface formed as set forth in Japanese Patent Application Post-Exam Publication No. Hei 6-46331. Accordingly, the edges at the boundaries between the adjacent recesses are deformed and hence the dimples become unclear as in the case of subjecting the dimpled surface to metal plating as stated in Japanese Patent Application Post-Exam Publication No. Hei 6-46331. For this reason, it is impossible to combine together the techniques disclosed in Japanese Patent Application Post-Exam Publication No. Hei 6-46331 and Japanese Gazette Containing the Patent No. 2705090. In this case also, it is extremely difficult to impart the above-described three functions to the developer carrier even more surely.

Moreover, all the developing devices stated in the above-described official gazettes are of the non-contact development type. Therefore, the techniques disclosed in these official gazettes cannot be applied directly to contact development type developing devices in which the developer carrier contacts the latent image carrier.

SUMMARY OF THE INVENTION

Accordingly, an object of the present invention is to prevent the adhesion of a developer to a non-image area and to prevent the occurrence of fogging and blur due to disconnection, thickening or scattering of thin lines of the image.

Another object of the present invention is to eliminate the delay in the supply of a developer from a developer supply member and to allow the developer to be supplied stably even when an AC-superimposed bias voltage is applied to a developer carrier.

Still another object of the present invention is to provide a contact development type developing device that has a developer carrier capable of exhibiting three functions, i.e. developer conveying function, developer charging function, and developing bias voltage discharge preventing function, even more surely, and that allows the developer carrier to be formed simply at reduced costs.

To attain the above-described objects, the present invention provides a developing device including a developer carrier for carrying a developer. A supply member is disposed to rotate in contact with the developer carrier to supply a developer layer having a predetermined thickness to the surface of the developer carrier. A layer forming member is disposed to abut against the developer carrier to regulate the layer thickness of the developer so as to form a thin developer layer on the developer carrier. A bias application unit applies an AC-superimposed bias voltage to the developer carrier. The AC-superimposed bias voltage is formed by superimposing an alternating current on a DC bias voltage. A latent image on a latent image carrier is developed with the thin developer layer formed on the developer carrier by the layer forming member. The bias application unit sets the maximum value of the AC-superimposed bias voltage lower than the charge potential of the latent image carrier.

Preferably, the bias application unit sets the DC bias voltage lower than a middle potential between the charge and exposure potentials of the latent image carrier. The minimum value of the AC-superimposed bias voltage may be set lower than the exposure potential of the latent image carrier. The maximum and minimum values of the AC-superimposed bias voltage may be set so as to be identical in polarity with each other.

In addition, the present invention provides a developing device including a developer carrier for carrying a developer. A supply member is disposed to rotate in contact with the developer carrier to supply a developer layer having a predetermined thickness to the surface of the developer carrier. A layer forming member is disposed to abut against the developer carrier to regulate the layer thickness of the developer so as to form a thin developer layer on the developer carrier. A bias application unit applies an AC-superimposed bias voltage to the developer carrier. The AC-superimposed bias voltage is formed by superimposing an alternating current on a DC bias voltage. A latent image on a latent image carrier is developed with the thin developer layer formed on the developer carrier by the layer forming member. The bias application unit sets the minimum value of the AC-superimposed bias voltage higher than the exposure potential of the latent image carrier.

Preferably, the bias application unit sets the maximum and minimum values of the AC-superimposed bias voltage identical in polarity with each other. The maximum value of the AC-superimposed bias voltage may be set lower than the charge potential of the latent image carrier. The maximum value of the AC-superimposed bias voltage may be set higher than the charge potential of the latent image carrier.

In addition, the present invention provides a developing device including a developer carrier for carrying a developer. A supply member is disposed to rotate in contact with the developer carrier to supply a developer layer having a predetermined thickness to the surface of the developer carrier. A layer forming member is disposed to abut against the developer carrier to regulate the layer thickness of the developer so as to form a thin developer layer on the developer carrier. A bias application unit applies an AC-superimposed bias voltage to the developer carrier. The AC-superimposed bias voltage is formed by superimposing an alternating current on a DC bias voltage. A latent image on a latent image carrier is developed with the thin developer layer formed on the developer carrier by the layer forming member. The charge potential $V_0$ and exposure potential $V_{on}$ of the latent image carrier, the peak-to-peak voltage $V_{pp}$ of the AC-superimposed bias voltage and the DC bias voltage $V_{dc}$ are set so as to satisfy the following conditions:

$$|V_0-V_{on}|\geqq|V_{pp}|$$

$$|V_{dc}|\leqq|V_0-V_{on}|/2$$

In addition, the present invention provides a developing device including a developer carrier for carrying a developer. A supply member is disposed to rotate in contact with the developer carrier to supply a developer layer having a predetermined thickness to the surface of the developer carrier. A layer forming member is disposed to abut against the developer carrier to regulate the layer thickness of the developer so as to form a thin developer layer on the developer carrier. A bias application unit applies an AC-superimposed bias voltage to the developer carrier. The AC-superimposed bias voltage is formed by superimposing an alternating current on a DC bias voltage. A latent image on a latent image carrier is developed with the thin developer layer formed on the developer carrier by the layer forming member. The bias application unit has a constant-current bias source for applying a constant-current bias voltage to the supply member to supply a constant current between the supply member and the developer carrier in such a manner as to follow the AC-superimposed bias voltage.

Preferably, the bias application unit includes an AC-superimposed bias source for applying the AC-superimposed bias voltage to the developer carrier and a constant-current bias source for applying the constant-current bias voltage to the supply member. The constant-current bias source has sufficiently high responsivity to follow the AC-superimposed bias voltage. The constant-current bias source is connected directly between the developer carrier and the supply member. The constant-current bias source follows the AC-superimposed bias voltage with a peak-to-peak voltage at least 0.5 times the peak-to-peak voltage of the AC-superimposed bias voltage.

In addition, the present invention provides a contact development type developing device having a developer carrier disposed in contact with a latent image carrier. The developer carrier carries a developer on the surface thereof to convey it to the latent image carrier. The developer carrier is formed from a metal roller. At least a developer carrier region of the surface of the metal roller is subjected to sandblasting treatment to form a dimpled surface. Further, at least the dimpled surface of the metal roller is subjected to aluminum anodizing treatment.

The developing device has a bias application unit for applying a developing bias voltage to the developer carrier. The developing bias voltage is an AC-superimposed bias voltage formed by superimposing an alternating current on a direct current. The developing bias potential is set closer to the electric potential set for the image area on the latent image carrier than the electric potential set for the non-image area on the latent image carrier. In other words, the developing bias potential is not set on the side of the non-image area electric potential remote from the image area electric potential. The circumferential speed of the developer carrier is set higher than the circumferential speed of the latent image carrier. The developer is a non-magnetic one-component toner prepared by externally adding an external additive having a predetermined hardness to toner particles. The hardness of the surface of the metal roller is set lower than the hardness of the external additive. The sphericity of the particles of the developer is set in the range of 0.9 to 1 in terms of Wadell's practical sphericity.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 14 is a diagram showing comparatively the results of an evaluation performed on examples regarding the setting of the AC-superimposed bias voltage shown in FIG. 3.

FIG. 15 is a diagram showing comparatively the results of an evaluation performed on examples regarding the setting of the AC-superimposed bias voltage shown in FIG. 4.

FIG. 16 is a diagram showing comparatively the results of an evaluation performed on examples regarding the setting of the AC-superimposed bias voltage shown in FIG. 5.

FIG. 17 is a diagram showing comparatively the results of an evaluation performed on examples regarding the setting of the AC-superimposed bias voltage shown in FIG. 6.

DESCRIPTION OF PREFERRED EMBODIMENTS

Figure 1:
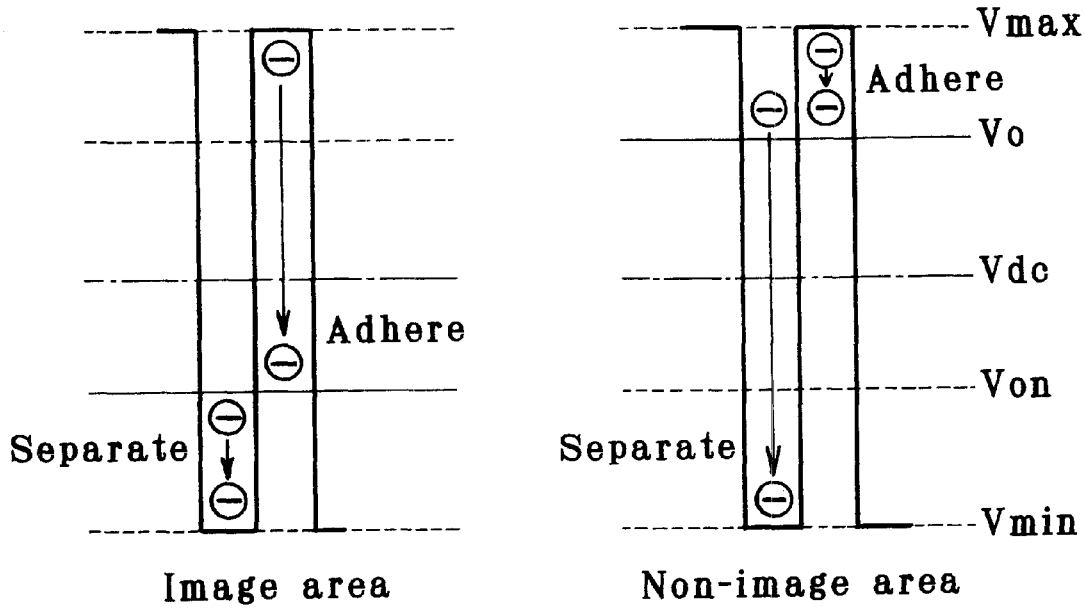
FIG. 1 is a diagram for describing the magnitude of an AC-superimposed bias voltage applied to a developer carrier of a developing device.
Figure 2:
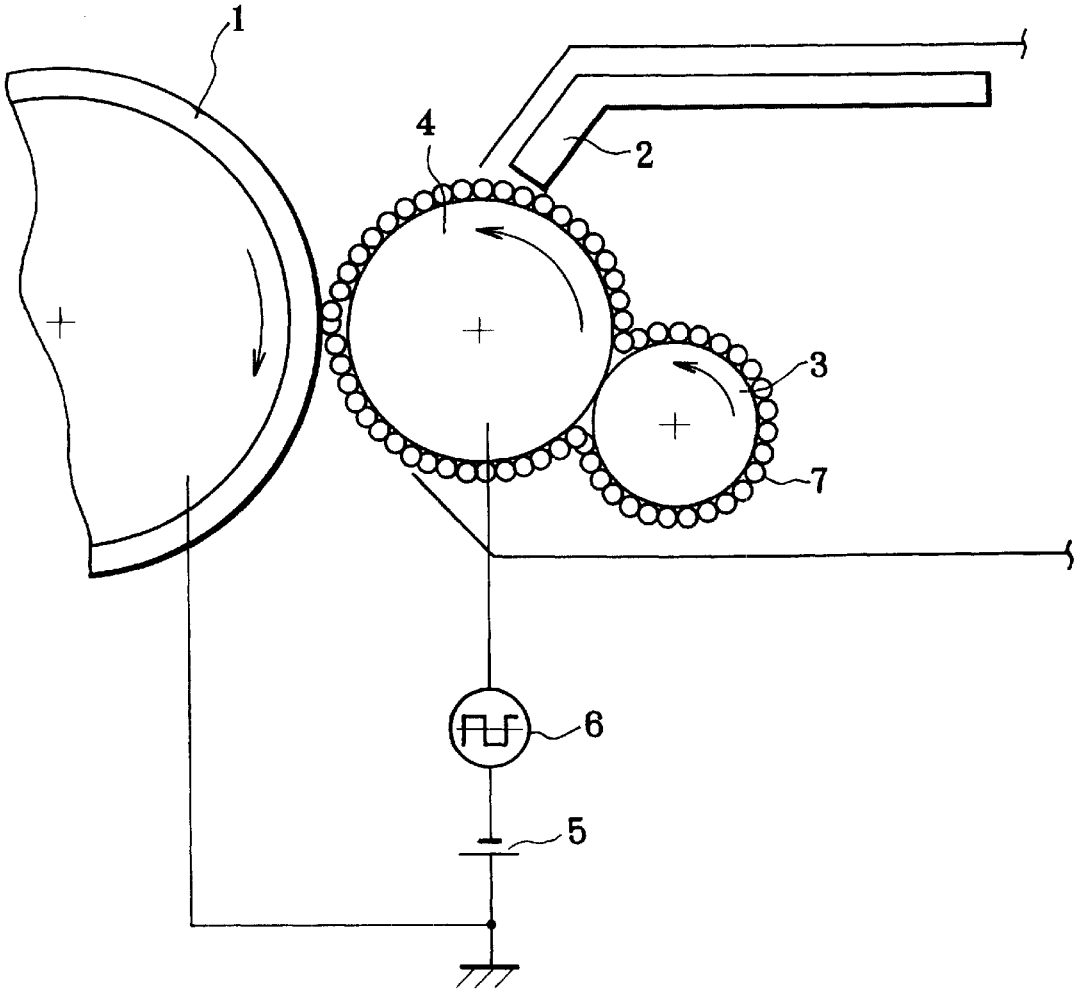
'FIG. 2 is a diagram for describing an embodiment of the developing device according to the present invention.
Figure 3A:
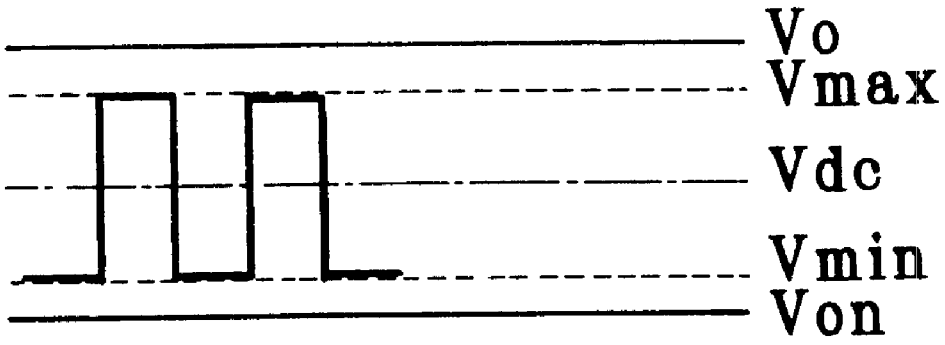
FIG. 3 is a diagram showing an example of setting of an AC-superimposed bias voltage in the developing device according to the present invention.
Figure 3B:
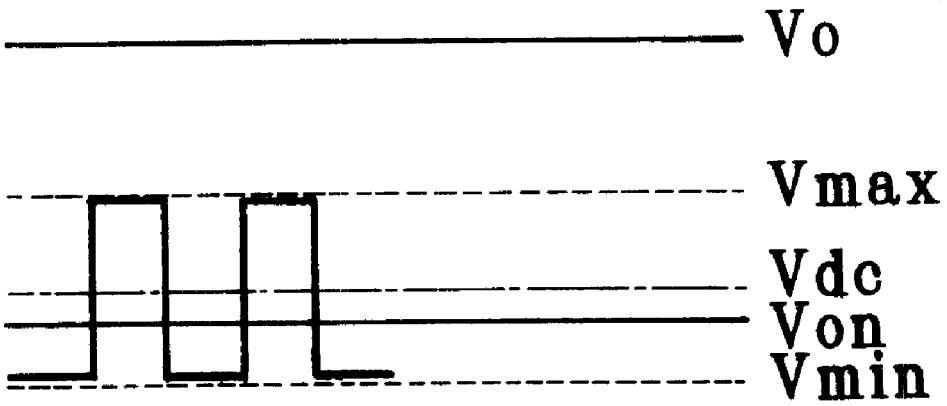
Figure 7:
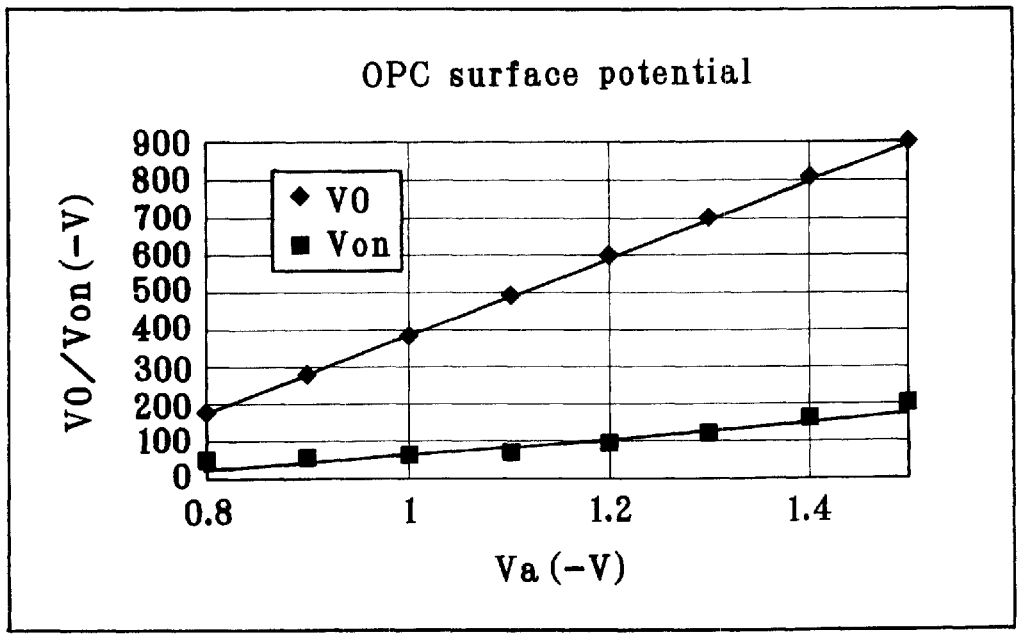
FIG. 7 is a diagram for describing the relationship between a DC bias voltage applied to a charging roller and the surface potential of a latent image carrier.
Figure 8:
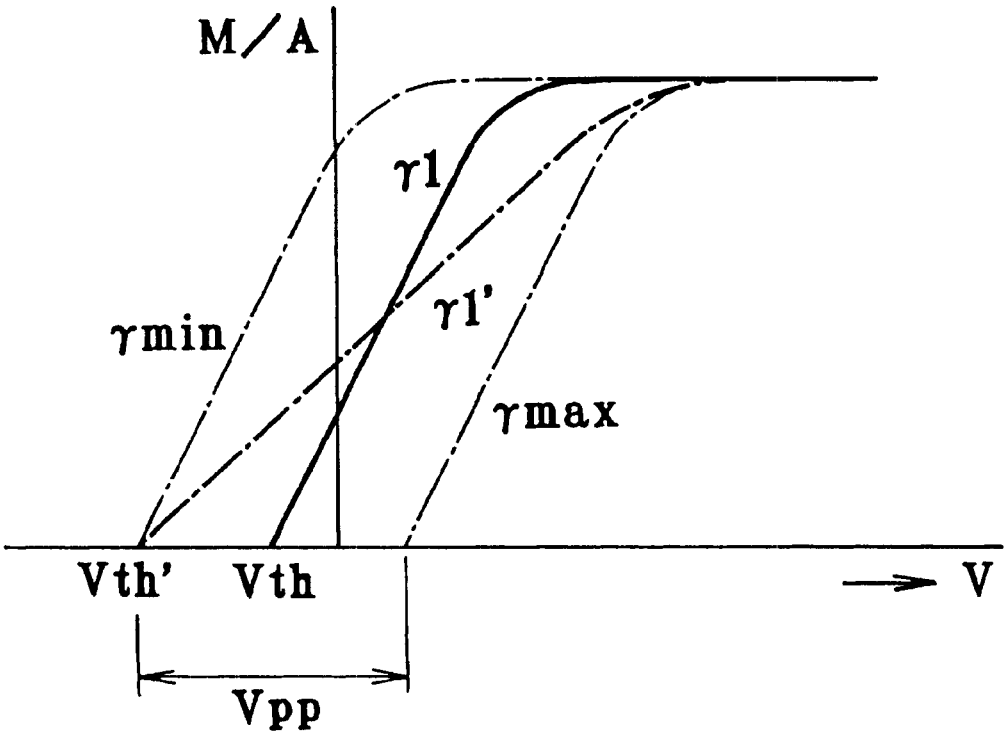
FIG. 8 is a diagram for describing the relationship between development γ, AC-superimposed bias peak-to-peak voltage $V_{pp}$ (voltage between the maximum and minimum values of the AC-superimposed bias voltage) and threshold value $V_{th}$.

An embodiment of the present invention will be described below with reference to the accompanying drawings. FIG. 2 is a diagram for describing an embodiment of the developing device according to the present invention. FIG. 3 is a diagram for describing an AC-superimposed bias voltage used in the developing device according to the present invention. FIG. 7 is a diagram for describing the relationship between a DC bias voltage applied to a charging roller and the surface potential of a latent image carrier. FIG. 8 is a diagram for describing the relationship between development γ, AC-superimposed bias peak-to-peak voltage $V_{pp}$, and threshold value $V_{th}$. In FIG. 2, reference numerals denote constituent elements as follows: 1 denotes a latent image carrier; 2 denotes a layer forming member; 3 denotes a supply member; 4 denotes a developer carrier; 5 denotes a DC bias source; 6 denotes an AC bias source; and 7 denotes a developer.

In FIG. 2, the latent image carrier 1 is arranged as follows. A surface potential (charge potential; non-image area potential) $V_0$ for a non-image area is set, for example, by application of a DC bias voltage $V_a$ to a charging roller (not shown) driven to rotate in contact with the latent image carrier 1. When writing is executed in accordance with exposure data, an image area potential (exposure potential) $V_{on}$ is produced, whereby an electrostatic latent image is formed. The developer carrier 4 contacts the latent image carrier 1 and allows the developer 7 to adhere to the electrostatic latent image formed on the surface of the latent image carrier 1 in accordance with the exposure data, thereby developing the latent image. The supply member 3 is placed to rotate in contact with the developer carrier 4 to supply the developer 7 to the developer carrier 4. The layer forming member 2 is an elastic regulating member for forming a thin layer of developer on the developer carrier 4. The DC bias source 5 and the AC bias source 6 are used to apply an AC-superimposed bias voltage to both the developer carrier 4 and the supply member 3.

In the following description, the DC bias voltage is denoted by $V_{dc}$, and the maximum value and minimum value of an AC-superimposed bias voltage formed by superimposing an alternating current on the DC bias voltage $V_{dc}$ are denoted by $V_{max}$ and $V_{min}$, respectively. The peak-to-peak voltage (voltage between the maximum and minimum values of the AC-superimposed bias voltage) is denoted by $V_{pp}$ ($=V_{max}-V_{min}$). In the present invention, these voltages are set as follows.

To prevent the adhesion of the developer to the non-image area, as shown in FIG. 3, the DC bias voltage $V_{dc}$ or the peak-to-peak voltage $V_{pp}$ ($=V_{max}-V_{min}$) of the AC-superimposed bias voltage is adjusted so that the maximum value $V_{max}$ of the AC-superimposed bias voltage is lower then the charge potential $V_0$ of the latent image carrier 1.

For example, if the DC bias voltage $V_{dc}$ is set at a value just middle between the charge potential $V_0$ and the exposure potential $V_{on}$ of the latent image carrier 1, as shown in part (a) of FIG. 3, the peak-to-peak voltage $V_{pp}$ ($=V_{max}-V_{min}$) of the AC-superimposed bias voltage becomes smaller than the width ($=V_0-V_{on}$) between the charge potential $V_0$ and the exposure potential $V_{on}$ of the latent image carrier 1. As the DC bias voltage $V_{dc}$ is made lower than the value set as shown in part (a) of FIG. 3, the peak-to-peak voltage $V_{pp}$ of the AC-superimposed bias voltage shifts as shown in part (b) of FIG. 3. In this case, the peak-to-peak voltage $V_{pp}$ of the AC-superimposed bias voltage can be increased within a range not exceeding the charge potential $V_0$ of the latent image carrier 1.

If the maximum value $V_{max}$ of the AC-superimposed bias voltage is set lower than the charge potential $V_0$ at the non-image area on the latent image carrier 1, when the minimum value $V_{min}$ of the AC-superimposed bias voltage exceeds the exposure potential $V_{on}$ as shown in part (a) of FIG. 3, the developer adheres to the image area on the latent image carrier 1 according to the direction of the electric field. However, the developer does not separate from the latent image carrier 1 to return to the developer carrier 4 because the direction of the electric field from the latent image carrier 1 toward the developer carrier 4 does not change. Adhesion of the developer does not occur in the non-image area.

On the other hand, when the minimum value $V_{min}$ of the AC-superimposed bias voltage is lower than the exposure potential $V_{on}$ as shown in part (b) of FIG. 3, the developer adheres to the image area on the latent image carrier 1 according to the direction of the electric field. However, at a region where the exposure potential $V_{on}$ and the minimum value $V_{min}$ of the AC-superimposed bias voltage are inverted relative to each other, the developer is separated from the latent image carrier 1 to return to the developer carrier 4. Therefore, the developer adhering to the image area to excess is separated moderately. Accordingly, it is possible to reduce density unevenness and defacement of the image. At the non-image area, adhesion of the developer does not occur as in the case of part (a) of FIG. 3.

The peak-to-peak voltage $V_{pp}$ and the DC bias voltage $V_{dc}$ can be set as desired within the limits of the maximum value $V_{max}$ of the AC-superimposed bias voltage. Therefore, either of the above-described situations occurs according to how the peak-to-peak voltage $V_{pp}$ or the DC bias voltage $V_{dc}$ is set. In either case, no developer adheres to the non-image area. Accordingly, it is possible to form a favorable image free from background fogging.

At the image area, there is a difference in the gradient of the development γ curve between the cases shown in parts (a) and (b) of FIG. 3. In the settings shown in part (b) of FIG. 3, the γ value becomes smaller because separation of the developer occurs. In other words, the development γ curve slopes more gently. However, in either case, it is possible to provide improved gradation characteristics and to minimize image unevenness by design and hence possible to obtain favorable image quality. In any case, the present invention makes it possible to obtain favorable image quality free from background fogging by eliminating the adhesion of the developer to the non-image area. In this regard, the present invention provides an extremely advantageous effect.

Figure 4A:
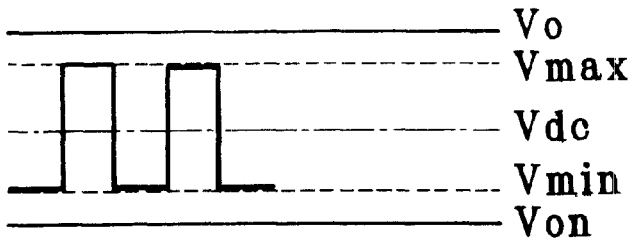
FIG. 4 is a diagram showing another example of setting of an AC-superimposed bias voltage in the developing device according to the present invention.
Figure 4B:
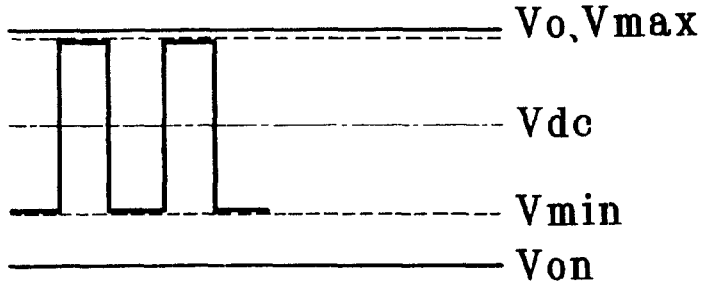
Figure 4C:
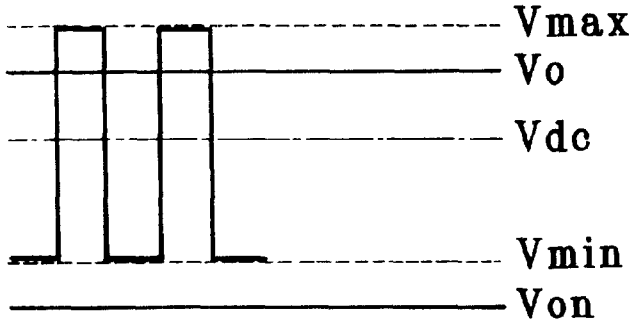

To allow the developer to adhere to the image area even more effectively and to prevent separation of the developer at the image area, each bias voltage is set so that the minimum value $V_{min}$ of the AC-superimposed bias voltage is always kept from becoming lower than the exposure potential $V_{on}$ of the latent image carrier 1 as shown in FIG. 4. Part (a) of FIG. 4 shows an example in which $V_{pp}$ is changed under the condition of $|V_{on}| \leqq |V_{min}|$ to set the condition of $|V_0| > |V_{max}|$. Part (b) of FIG. 4 shows an example in which $|V_0| = |V_{max}|$. Part (c) of FIG. 4 shows an example in which $|V_0 < |V_{max}|$. If each bias voltage is set as shown in FIG. 4, the condition of $|V_{on}| \leqq |V_{min}|$ is always valid at the image area. Thus, the electric field acts in a direction in which the developer adheres to the image area. Consequently, the developer adheres to the image area, but separation of the developer does not occur at the image area. Accordingly, there is no scattering due to the vibration of the developer, and it becomes possible to develop the latent image faithfully. However, in a case where $|V_0| \leqq |V_{max}|$ as shown in parts (b) and (c) of FIG. 4, the developer may adhere to the non-image area. In such a case, the settings of each bias voltage should be adjusted so that the adhesion of the developer to the non-image area is reduced to such a small extent that there is no problem in the actual use by observing images developed in various modes, e.g. after the change in environmental conditions or after continuous printing.

To allow the developer to adhere to the image area even more effectively and to eliminate the adhesion of the developer to the non-image area, the maximum value $V_{max}$ of the AC-superimposed bias voltage is set lower than the charge potential $V_0$ of the latent image carrier 1 and, at the same time, the minimum value $V_{min}$ of the AC-superimposed bias voltage is set higher than the exposure potential $V_{on}$ of the latent image carrier 1. Alternatively, the maximum value $V_{max}$ and minimum value $V_{min}$ of the AC-superimposed bias voltage are set identical in polarity with each other. With such settings of each bias voltage, the developer adheres to the image area on the latent image carrier 1 according to the direction of the electric field. However, the developer does not separate from the image area on the latent image carrier 1 to return to the developer carrier 4 because the direction of the electric field from the latent image carrier 1 toward the developer carrier 4 does not change. At the non-image area, the direction of the electric field is opposite to the above. Therefore, adhesion of the developer does not occur in the non-image area.

Figure 5A:
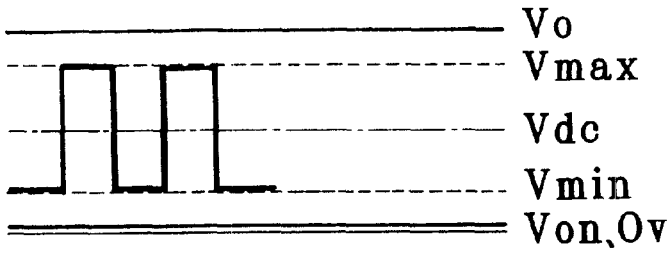
FIG. 5 is a diagram showing still another example of setting of an AC-superimposed bias voltage in the developing device according to the present invention.
Figure 5B:
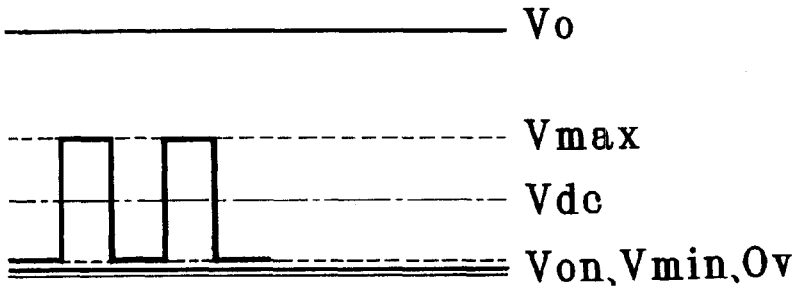
Figure 5C:
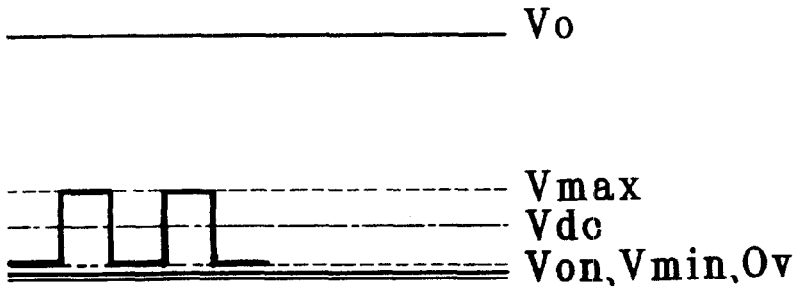

In general, the exposure potential $V_{on}$ of the latent image carrier 1 is approximately 0 V. Part (a) of FIG. 5 shows that the DC bias voltage $V_{dc}$ is set at a middle so that the minimum value $V_{min}$ of the AC-superimposed bias voltage is always higher than $V_{on}$ and the maximum value $V_{max}$ of the AC-superimposed bias voltage does not exceed the charge potential $V_0$ of the latent image carrier 1. To set the DC bias voltage $V_{dc}$ as desired for the purpose of density control, the DC bias voltage $V_{dc}$ can be controlled with $V_{pp}$ fixed until $V_{min}$ becomes equal to $V_{on}$ as shown in part (b) of FIG. 5. However, to lower the DC bias voltage $V_{dc}$ furthermore, it is necessary to reduce $V_{pp}$ and to control it so that $V_{min}$ is not lower than $V_{on}$, as shown in part (c) of FIG. 5. For this reason, it is necessary to choose between one method wherein $V_{pp}$ is variably controlled according to $V_{dc}$ and another method wherein $V_{pp}$ is fixed and $V_{dc}$ is controlled so as not to become lower than a predetermined value. In either case, if $V_{max}$ and $V_{min}$ are varied with the same polarity within a range in which the AC-superimposed bias voltage is not lower than 0 V, there is no injection of electric charge opposite in polarity to the developer. If $V_0$ is set in a certain range, the charge injection to the latent image carrier 1 becomes unlikely to occur. Thus, it becomes possible to form a favorable printed image by using extremely simple design parameters.

To prevent or minimize the adhesion of the developer to the non-image area, each bias voltage is set so as to satisfy the following conditions:

$$|V_{dc}| - V_{on}| \geqq |V_{pp}|$$

$$|V_{dc}| \leqq |V_0 - V_{on}|/2$$

Figure 6A:
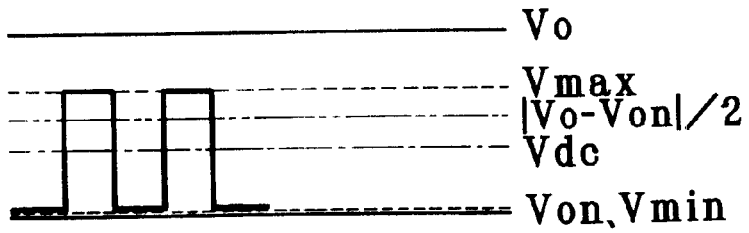
FIG. 6 is a diagram showing a further example of setting of an AC-superimposed bias voltage in the developing device according to the present invention.
Figure 6B:
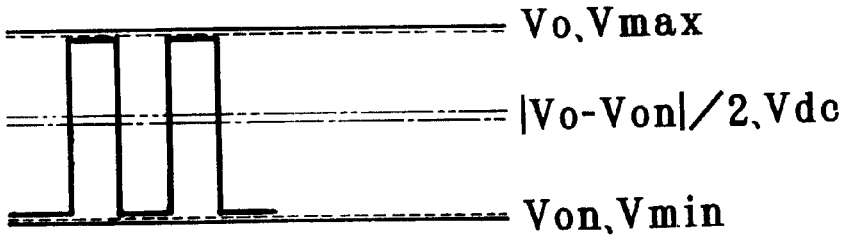
Figure 6C:
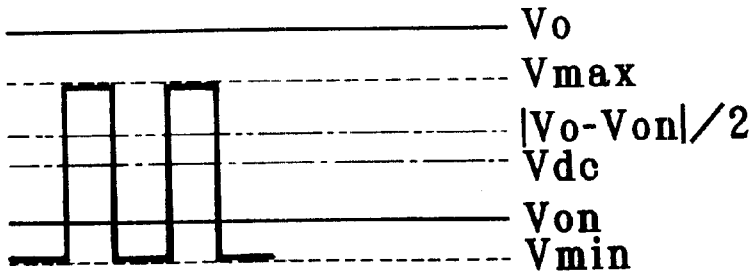

An example in which $|V_{min}| \geqq |V_{on}|$ and $V_{pp}$ is set relatively small is shown in part (a) of FIG. 6. An example in which $|V_0 - V_{on}| = |V_{pp}|$ and $|V_{dc}| = |V_0 - V_{on}|/2$ is shown in part (b) of FIG. 6. Part (c) of FIG. 6 shows an example in which $V_{dc}$ is made lower than the value set as shown in part (b) of FIG. 6. In the example shown in part (b) of FIG. 6, $|V_{max}| = |V_0|$ and $|V_{min}| = |V_{on}|$. In the case of part (c) of FIG. 6, $|V_{min}| < |V_{on}|$. By setting each bias voltage as stated above, it is possible to eliminate or minimize the adhesion of the developer to the non-image area to a level at which no problem arises in the actual use. Thus, the present invention provides an extremely advantageous effect. The present inventor conducted image formation with variously changed $V_0$, $V_{on}$, $V_{pp}$ and $V_{dc}$, and found the above-described conditions as conditions for printing free from fogging at the non-image area and capable of providing images with minimal density unevenness and further superior in gradation characteristics and reproduction of thin lines.

The greater the peak-to-peak voltage $V_{pp}$ of the AC-superimposed bias voltage, the more the DC γ curves separate from each other. Consequently, gradation characteristics are improved. However, there is a region in which the gradation improving effect no longer changes even if $V_{pp}$ is further increased. The inventor found that such a region is in the vicinity of $|V_0-V_{on}|$. Even when $V_{pp}$ was increased in excess of $|V_0-V_{on}|$, no substantial change was found in the effect, and problems such as destruction of the latent image on the latent image carrier and the occurrence of background fogging were likely to occur. Regarding background fogging, in particular, it was found that when $V_{pp}$ is excessively increased, background fogging occurs unavoidably, and it is necessary in order to remove the background fogging to intensify the separation action by the electric potential difference between $V_{min}$ and $V_0$, which requires extremely complicated design, i.e. further increasing $V_{pp}$ or changing the duty or waveform of the alternating current superimposed on the DC bias voltage. Even if such design was made, the developer once adhered to the latent image carrier was difficult to remove completely by the electric field alone because of the action of Van der Waals force and image force due to the developer charge. Accordingly, the present inventor found that the cleverest technique for obtaining a favorable image is to set each electric potential so that the adhesion of the developer to the non-image area is prevented as much as possible.

A simulation was performed to investigate the toner motion under application of the AC-superimposed bias voltage. In the simulation, the motion of toner was estimated from the image force between the developer carrier and the toner, the image force between the latent image carrier and the toner, and the toner driving force generated from the electric field between the developer carrier and the latent image carrier and the toner charge Q. A toner having an average particle size of 7 micrometers was used. A study of the particle size was made by using particle size distribution measurement data concerning the toner actually used. Regarding the toner specific charge Q/M, a simulation was also performed with a similar toner particle size distribution. The simulation revealed the following. Toner particles are caused to move by the electric field for adhesion of the toner from the developer carrier to the latent image carrier and the electric field for separation. When $V_{pp}$ exceeds $V_0$, the contrast potential with respect to $V_{on}$ becomes large. As a result, reciprocating motion of the toner occurs undesirably over a wide range around the nip between the developer carrier and the latent image carrier. In contrast, when $V_{pp}$ is not in excess of $V_0$, the development operation can be performed in a state where substantially no reciprocating motion of the toner occurs anywhere except the nip between the developer carrier and the latent image carrier. This phenomenon is particularly remarkable in the case of a toner having a large particle size and a toner having a small specific charge Q/M. In such a case, the action of image force with respect to the developer carrier and the latent image carrier is weak, so that toner particles are likely to float. As the proportion of such toner particles increases, toner scattering tends to increase rapidly. To confirm the results of the simulation, the vicinity of the nip between the developer carrier and the latent image carrier was observed by using a high-sensitivity camera. It was confirmed that when $V_{pp}$ exceeds $V_0$, a large amount of toner is scattered by an air flow generated according to the rotation of the developer carrier. When $V_{pp}$ was not in excess of $V_0$, toner scattering was not observed. It can be said from the above-described simulation and the results of the observation at the time of the development that the force for binding the toner to the developer carrier can be increased by setting $V_{pp}$ at a value not exceeding $V_0$.

Further, in a case where contact development is carried out in the color process, which has been increasing in recent years, it is necessary to separate the developer carrier from the latent image carrier in order to prevent color mixing at the time of changing colors. Consequently, the developer carrier and the latent image carrier repeat contact and separation. In this case, because the developer carrier is generally set at a higher circumferential speed than that of the latent image carrier, excess toner is likely to stay in an area upstream of the nip between the developer carrier and the latent image carrier. If the excess toner drops when the developer carrier separates from the latent image carrier, the interior of the apparatus is contaminated. Regarding the contamination of the interior of the apparatus, when $V_{pp}$ exceeds $V_0$, the toner is likely to fall from the developer carrier and hence apt to stay as excess toner, as in the case of the results of the above-described toner simulation. Therefore, the interior of the apparatus is likely to be contaminated. However, when $V_{pp}$ is not in excess of $V_0$, the toner is bound to the developer carrier side and hence will not drop when the developer carrier separates from the latent image carrier. Thus, it becomes possible to minimize the contamination of the interior of the apparatus.

As one example of setting of the above-described biases, if the DC bias voltage $V_a$ to be applied to the charging roller is set at −1200 V, the charge potential $V_0$ of the latent image carrier 1 is set at −600 V in excess of the maximum value $V_{max}$ of the developing bias voltage (AC-superimposed bias voltage), which is set equal to −500 V. The exposure potential $V_{on}$ of the latent image carrier 1 is set at −30 V, which is not in excess of the minimum value $V_{min}$ of the developing bias voltage, which is set equal to −100 V. The AC-superimposed bias voltage is controlled so that the peak-to-peak voltage $V_{pp}$ is 400 V, and the frequency f is 2 kHz, and further the DC bias voltage $V_{dc}$ is −300 V. As a power source for an AC-superimposed bias voltage to be applied to the developer carrier 4, a relatively inexpensive, simple power circuit can realize a rectangular wave of duty 50%, for example. Although a rectangular wave is used in this embodiment, it is also possible to use a trapezoidal wave, a triangular wave, a sine wave, etc. The duty is also changeable as desired.

The charge potential $V_0$ of the latent image carrier OPC can be measured with a surface potentiometer (e.g. Model 1344: available from TREK). The charge potential $V_0$ varies with the DC bias voltage $V_a$ applied to the charging roller. FIG. 7 is a graph showing the relationship between the DC bias voltage $V_a$ and the surface potentials $V_0$ and $V_{on}$. Thus, the surface potentials $V_0$ and $V_{on}$ can be determined by setting the DC bias voltage $V_a$. The DC bias voltage $V_{dc}$, the peak-to-peak voltage $V_{pp}$ and the DC bias voltage $V_a$ can be set as desired. Therefore, the DC bias voltage $V_a$ can be set, for example, as follows. The developer density on the intermediate transfer medium is detected. Thereafter, a DC bias voltage $V_{dc}$ and a peak-to-peak voltage $V_{pp}$ with which the desired density can be obtained are set. Then, the DC bias voltage $V_a$ is set from the relation of $V_0-V_a$ for which data entry has been made in advance according to the values of the set DC bias voltage $V_{dc}$ and peak-to-peak voltage $V_{pp}$.

In FIG. 8, the abscissa axis represents the electric potential V, and the ordinate axis represents the developer adhesion density. The characteristic curve showing development γ1' obtained with the AC-superimposed bias voltage having the peak-to-peak voltage $V_{pp}$ slopes gently in comparison to the characteristic curve showing development γ1 obtained with the DC bias voltage $V_{dc}$. Thus, gradation characteristics are improved. Let us assume that $\gamma_{min}$ represents development effected with a DC bias voltage set equal to the minimum value $V_{min}$ of the AC-superimposed bias voltage, and $\gamma_{max}$ represents development effected with a DC bias voltage set equal to the maximum value $V_{max}$ of the AC-superimposed bias voltage. If development is effected under application of an AC-superimposed bias voltage with this amplitude, the characteristic curve slopes gently between the two curves as shown in the figure. Accordingly, the development characteristic curve slopes more gently as the amplitude increases. In other words, development γ1' obtained with the AC-superimposed bias voltage depends on the magnitude of the peak-to-peak voltage $V_{pp}$ of the AC-superimposed bias voltage, and the threshold value $V_{th1}$ shifts toward $V_{th1}$, by an amount corresponding to an increase in the magnitude of the peak-to-peak voltage $V_{pp}$. It should be noted that the threshold values $V_{th1}$, and $V_{th1'}$ are bias voltage values at which the developer starts to adhere. Accordingly, if the bias voltage is set lower than the threshold values $V_{th1}$ and $V_{th1'}$, adhesion of the developer does not take place. When the bias voltage exceeds the threshold value $V_{th1}$ or $V_{th1}$, adhesion of the developer occurs. The degree of developer adhesion increases as the extent to which the bias voltage exceeds the threshold value increases. As will be clear from this, it is necessary to set the bias voltage lower than at least the threshold value in order to minimize fogging and to enhance the developer separating effect. Moreover, the threshold value can be shifted not only by changing the DC bias voltage $V_{dc}$ but also by changing the peak-to-peak voltage $V_{pp}$ of the AC-superimposed bias voltage.

Figure 9:
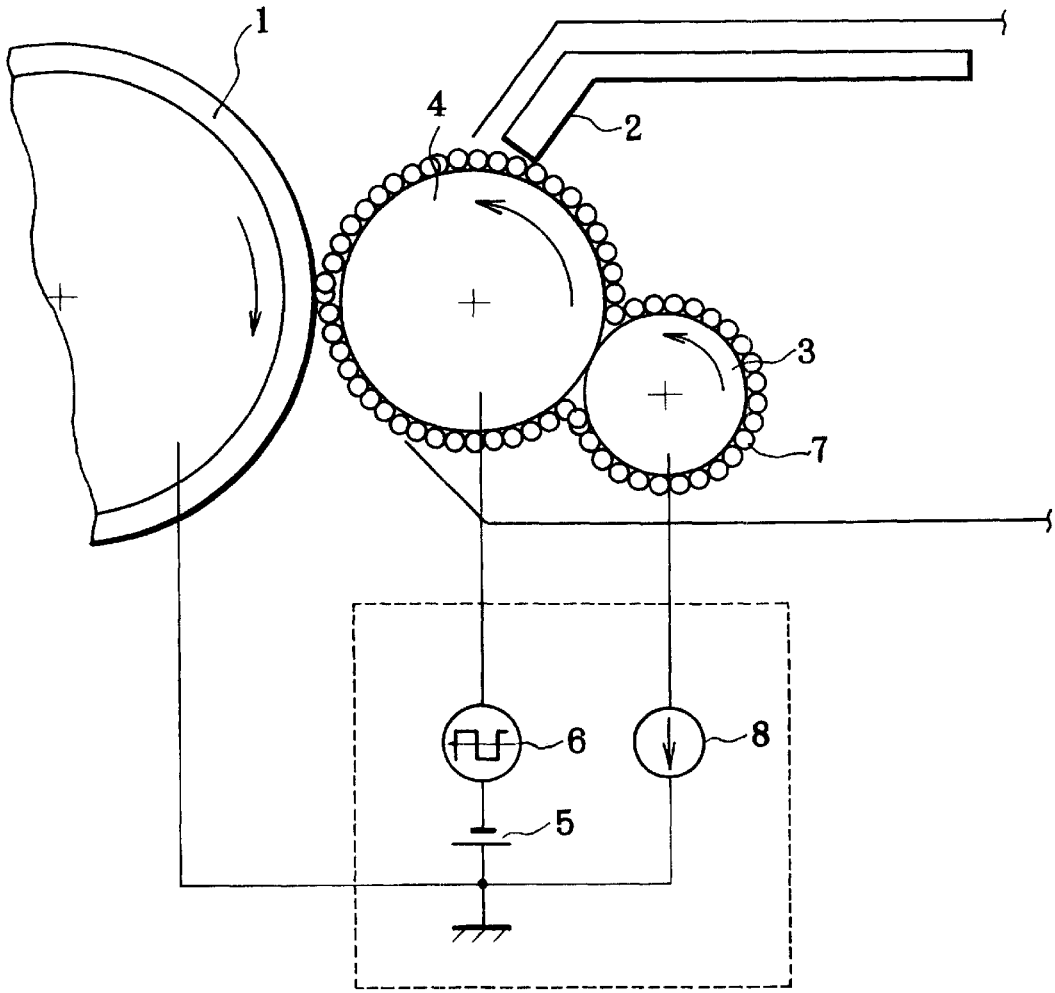
FIG. 9 is a diagram showing another embodiment of the developing device according to the present invention.

FIG. 9 is a diagram showing another embodiment of the developing device according to the present invention. In the figure, reference numeral 8 denotes a DC bias source. In the embodiment shown in FIG. 9, an AC-superimposed bias voltage formed by superimposing the voltage of the DC bias source 5 and the voltage of the AC bias source 6 on one another is applied to the developer carrier 4, and a DC bias voltage is applied to the supply member 3 from the DC bias source 8. The bias voltage applied to the supply member 3 forms an electric field that causes the developer to be supplied to the developer carrier 4 from the supply member 3.

As has been stated above, in the developing device according to the present invention, the supply bias voltage applied to the supply member 3 is subjected to constant-current control by the constant-current bias source 8. The developing device uses a bias source capable of following the alternating current superimposed on the developing bias voltage applied to the developer carrier 4. In a case where the supply bias voltage applied to the supply member 3 is subjected to constant-voltage control, for example, the electric potential does not follow the alternating current superimposed on the developing bias voltage. Consequently, the supply of the developer delays, and a favorable image cannot be obtained. Therefore, such a system cannot serve for the actual use. In the case of employing a supply bias source that performs simply constant-current control, the electric potential cannot follow the alternating current superimposed on the developing bias voltage. If the follow-up performance of the electric potential is inferior, the results of the development undesirably become similar to those in the case of constant-voltage control. If the supply current is increased, the required toner supply can be ensured, but the amount of toner conveyed becomes excessively large. Consequently, image defects such as stripes due to positive charge occur in the developed image. Further, fogging occurs in the developed image. Accordingly, it has been found that the supply current should not be excessively large but reasonable and needs to be improved in follow-up performance.

With the follow-up performance of the electric potential varied in the constant-current control, images were produced to perform an evaluation. As a result, it was possible to obtain favorable image quality, provided that $V_{pp}$ of the supply bias source applied to the supply member 3 was not less than 0.5 times the peak-to-peak voltage $V_{pp}$ of the developing bias voltage applied to the developer carrier 4 as follow-up performance. Regarding the allowable range of follow-up performance, a satisfactory evaluation result was obtained as long as $V_{pp}$ of the supply bias voltage was not less than 0.5 times $V_{pp}$ of the developing bias voltage. However, it is desirable that $V_{pp}$ of the supply bias voltage be not less than 0.8 times $V_{pp}$ of the developing bias voltage. An extremely favorable and uniform image was obtained when $V_{pp}$ of the supply bias voltage was not less than 0.8 times $V_{pp}$ of the developing bias voltage. When the follow-up performance was below the above-described level, a delay in the supply of the developer occurred, and a reduction in the density appeared markedly in the latter half of the developed image.

Figure 10:
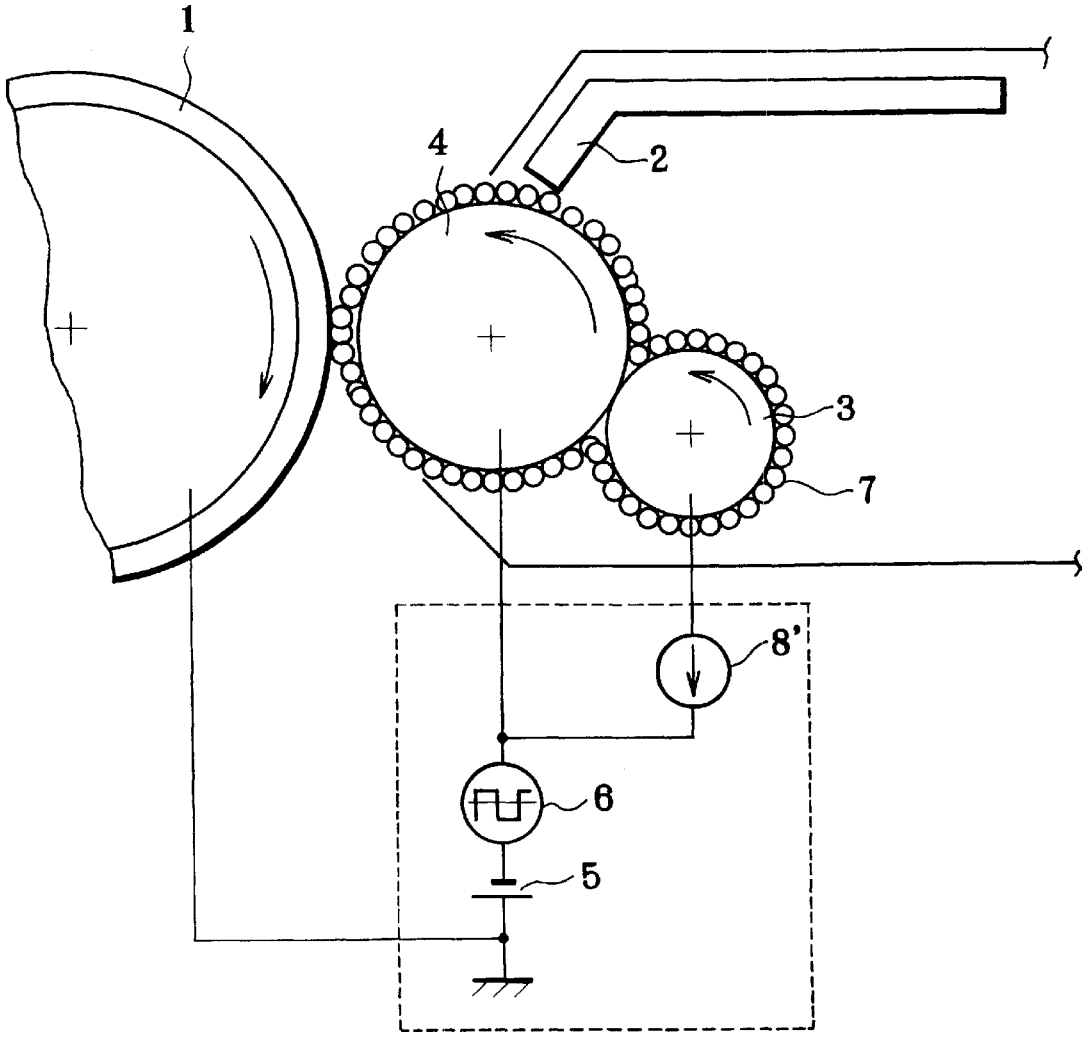
FIG. 10 is a diagram showing still another embodiment of the developing device according to the present invention.

FIG. 10 is a diagram showing still another embodiment of the developing device according to the present invention. In the embodiment shown in FIG. 9, the constant-current bias source 8 is required to exhibit follow-up performance of at least 0.5 times with respect to the electric potential of the developer carrier 4 under application of the AC-superimposed bias voltage in order to obtain a favorable and uniform image, as stated above. In the embodiment shown in FIG. 10, a constant-current bias source 8' is connected directly between the developer carrier 4 and the supply member 3, thereby realizing high follow-up performance. Thus, the constant-current bias source 8' is connected in such a manner as to float on the AC-superimposed bias voltage applied to the developer carrier 4 to perform constant-current control between the developer carrier 4 and the supply member 3. With this arrangement, the constant-current bias source 8' may be one that has substantially no capability of following the alternating current superimposed on the developing bias voltage.

Figure 11:
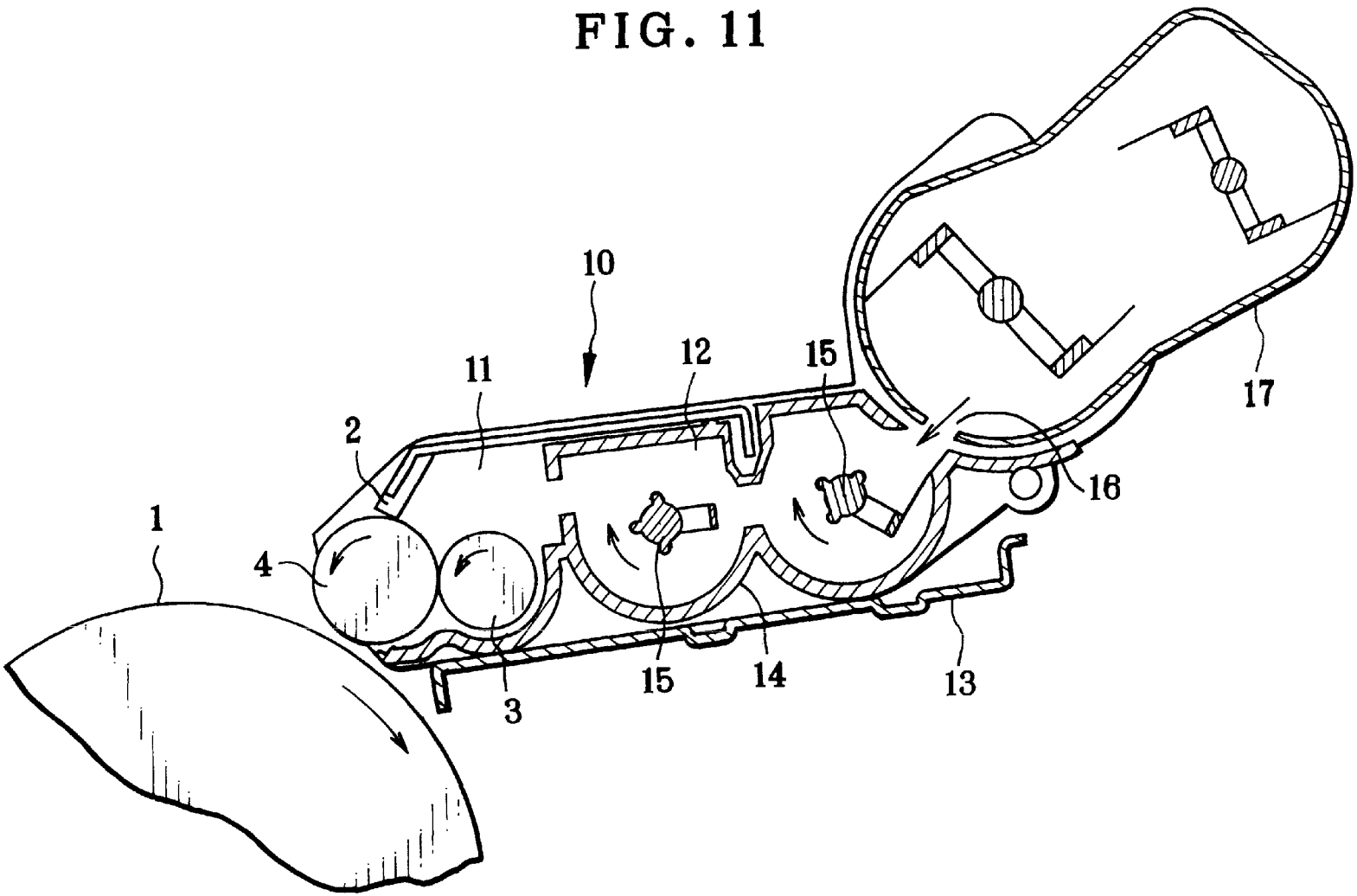
FIG. 11 is a diagram schematically showing an example of the whole structure of the developing device according to the present invention.

FIG. 11 is a diagram schematically showing an example of the whole structure of the developing device according to the present invention. In the figure, reference numerals denote constituent elements as follows: 11 denotes a development chamber; 12 denotes a sub-hopper; 13 denotes a base; 14 denotes a frame; 15 denotes an agitator mechanism; 16 denotes a toner supply opening; and 17 denotes a toner cartridge. It should be noted that a full-color developing system has four developing devices for yellow Y, magenta M, cyan C and black Bk; in FIG. 11, however, only one developing device is shown.

In FIG. 11, a latent image carrier 1 is an elastic roller with a photosensitive layer formed on the surface thereof. The latent image carrier 1 is provided with a backup roller for supporting the elastic roller from the inside thereof at a position where the surface of the latent image carrier 1 contacts another member, e.g. a charging unit. The developing device is provided to face the latent image carrier 1, for example. The developing device has a frame 14 secured to a base 13. A sub-hopper 12 contains an agitator mechanism 15 for stirring and conveying a developer supplied from a toner cartridge 17 through a toner supply opening 16. The developing device further includes a supply member 3 for supplying the developer conveyed from the agitator mechanism 15. A developer carrier 4 is in resilient contact with the supply member 3 to transfer the developer supplied to the surface thereof to the latent image carrier 1. Further, the developing device includes a layer forming member 2 for regulating the thickness of a thin layer of developer on the surface of the developer carrier 4.

The developer carrier 4 and the supply member 3 are placed in resilient contact with each other and rotate against each other with a circumferential speed difference. In this way, the developer on the supply member 3 is scraped onto the developer carrier 4 to form a developer layer with a predetermined thickness (e.g. several hundred micrometers) on the surface of the developer carrier 4. At this time, the developer is electrically charged to a predetermined polarity by friction between the developer carrier 4 and the supply member 3. Further, the developer is regulated to a layer thickness of the order of 10 micrometers with the layer forming member 2. At this time, the developer is also electrically charged to the same polarity by friction between the developer and the layer forming member 2. The developer carrier 4 and the latent image carrier 1 rotate in the forward direction while slipping owing to a circumferential speed difference. In this way, the developer carrier 4 develops the electrostatic latent image on the latent image carrier 1 in a contact development manner.

To effect the above-described development, an AC-superimposed bias voltage is applied to the developer carrier 4 so as to allow the developer to adhere to the latent image carrier 1 to form an image. In addition, a bias voltage is applied to the supply member 3 to form an electric field for supplying the developer to the developer carrier 4. For example, a constant-current voltage source is connected to the supply member 3 to apply a supply bias voltage thereto such that a constant current flows with respect to the developer carrier 4 for each developing unit: $I_s=-2\ \mu A$ for each of the yellow and magenta developing units; $I_s=-3\ \mu A$ for the cyan developing unit; and $I_s=-5\ \mu A$ for the black developing unit. The system is so controlled that voltages are applied to the developer carrier 4 and the supply member 3 only when the latent image on the latent image carrier 1 is to be developed; no voltage is applied thereto on any other occasion.

Next, each constituent member of the foregoing developing device will be described in detail by way of a specific example. First, the developer carrier is made by subjecting the surface of an aluminum shaft to aluminum anodizing treatment after forming dimples on the surface by shot blasting. The shot blasting is carried out using spherical ceramic beads of #400 with a nozzle driven to reciprocate so that the whole area of the aluminum shaft rotating at 20 rpm is subjected to shot blasting with a shot pressure of 2 kg/cm$^2$ and a nozzle distance of 30 centimeters for 30 seconds, thereby forming dimples on the surface of the aluminum shaft. Beads usable for the shot blasting are not necessarily limited to ceramic beads. Glass beads and iron beads, e.g. stainless steel beads, are also usable. After the above-described shot blasting treatment, the surface roughness was measured. The surface roughness Rz was 7.5 micrometers, and Pc was 230. The surface of the aluminum shaft was sectioned and observed under a magnification of 500 to 1000× with an electron microscope (SEM). It was observed that the surface was formed with crater-like, uniform dimples.

The layer forming member 2 comprising an elastic regulating member is a rigid metal plate with a rubber tip provided at the distal end thereof. As the rigid metal plate, a stainless steel plate with a thickness of 1.5 millimeters is used, and urethane rubber is used as the rubber tip. The urethane rubber has carbon black dispersed therein to exhibit an electrical conductivity of $10^5$ Ωcm as expressed by volume resistivity. If the volume resistivity of the urethane rubber is high, the electric potential of the layer forming member will not become the same as that of the developer carrier even when the layer forming member is brought into contact with the developer carrier. In such a case, it is impossible to obtain the developer screening effect of the electric field. Consequently, the conveying surface of the developer carrier fails to become a line-shaped uneven conveying surface. Alternatively, the lines of the line-shaped uneven conveying surface become extremely low in contrast. The volume resistivity of the urethane rubber was varied to evaluate the quality of the line-shaped uneven conveying surface formed. As a result, it was found that an ideal line-shaped uneven conveying surface can be formed when the volume resistivity of the urethane rubber is not more than $10^9$ Ωcm. The rubber hardness Hs of urethane rubber should preferably be 55 to 80 degrees according to JIS A. If the rubber hardness is excessively high, the rubber elasticity becomes unable to function as desired. As a result, it becomes impossible for the layer forming member to follow the developer carrier satisfactorily. Hence, it becomes difficult to form a line-shaped uneven conveying surface on the developer carrier. When the rubber hardness is excessively low, the rubber vibrates undesirably when contacting the developer carrier. The vibration of the rubber disturbs the line-shaped uneven conveying surface, which should be formed in correspondence to the frequency of the AC-superimposed bias voltage.

For example, a urethane rubber material with a rubber hardness of 70 degrees is used. Such a urethane rubber material is provided on the distal end of a rigid metal plate by injection molding process. After the injection molding process, a portion of the rubber that is to contact the developer carrier is ground to a shape with a predetermined radius. A step portion is formed on the layer forming member during the inspection process. A step portion with a desired size is produced at a desired position by appropriately selecting the configuration of the grinding wheel and the volume of material removed. It is also possible to form a step portion with a desired size at a desired position by employing a mold used in the injection molding process. The layer forming member in this embodiment is formed with a step portion of 0.1 millimeter in size at a position 1.5 millimeters away from the contact position. The surface roughness of the layer forming member is produced by changing the roughness of the grinding wheel used in the grinding process. The surface roughness Ra at the upstream side is 0.3 micrometers. The surface roughness Ra at the downstream side is 0.08 micrometers. The layer forming member produced in this way is brought into contact with the developer carrier at an edge thereof. The layer forming member is provided with a positioning slot so that the edge contact is always kept at a fixed angle and parallel to the developer carrier with a positioning pin. The edge contact enables a thin developer layer to be formed with a reduced contact load and allows a reduction in the area of a wedge-shaped portion (i.e. a triangular portion between the layer forming member and the developer carrier) where the developer enters. Consequently, developer clogging becomes unlikely to occur, and it is possible to form a line-shaped uneven conveying surface uniform in the longitudinal direction of the developer carrier.

As the supply member, a urethane foam roller is placed in pressure contact with the developer carrier and rotated in a direction against the direction of rotation of the developer carrier with a constant circumferential speed ratio. The volume resistivity of the urethane foam should preferably be $10^5$ to $10^8$ Ωcm. If the volume resistivity is excessively high, the electric charge cannot follow effectively. Consequently, the desired supply bias effect cannot be obtained. An excessively low volume resistivity is not favorable because leakage would occur between the supply member and the developer carrier. In this embodiment, a urethane foam material with a volume resistivity of $10^7$ Ωcm is used. The nip of contact between the urethane foam roller and the developer carrier should preferably be 2 to 4.5 millimeters. If the contact nip is smaller than the above-described nip range, the developer supply force reduces undesirably. If the contact nip is larger than the above-described nip range, the torque required to drive the developer carrier becomes undesirably large, causing image quality degradation owing to banding and so forth. In this embodiment, the contact nip is set at 3.5 millimeters. The ratio of the circumferential speed of the urethane foam roller to that of the developer carrier should preferably be 0.3 to 1 in a case where these roller rotate against each other. If the circumferential speed ratio is excessively low, the supply of the developer becomes insufficient. If the circumferential speed ratio is excessively high, the driving torque increases, causing the image quality to be degraded. In this embodiment, the circumferential speed ratio is set at 0.53. The cell diameter of the urethane foam material should preferably be 10 to 50 times the volume-average particle size of the developer used. If the cell diameter is small relative to the volume-average particle size of the developer used, the cells of the urethane foam roller are undesirably clogged with the developer, and the supply of the developer becomes insufficient. If the cell diameter is large relative to the volume-average particle size of the developer used, brush marks due to the undesirably large cells appear in the developed image, causing image quality degradation. In this embodiment, a urethane foam material with a cell diameter of 120 micrometers, which is about 17 times the volume-average particle size of the developer, i.e. 7 micrometers, is used.

After the developing device had been assembled, a developer containing a polyester resin material as a main component was sealed in the developing device. The matrix particles of the developer were prepared by kneading a polyester resin material, a pigment, a charge control agent and wax at high temperature, followed by grinding and classification. In measurement with a Coulter counter (TA-11; available from Coulter Electronics Co.), which is a grain size measuring device, the volume-average particle size was 7 micrometers in volumenometry. In this embodiment, a developer obtained by externally adding 3 wt % of fine silica particles to the matrix particles was used.

Figure 12:
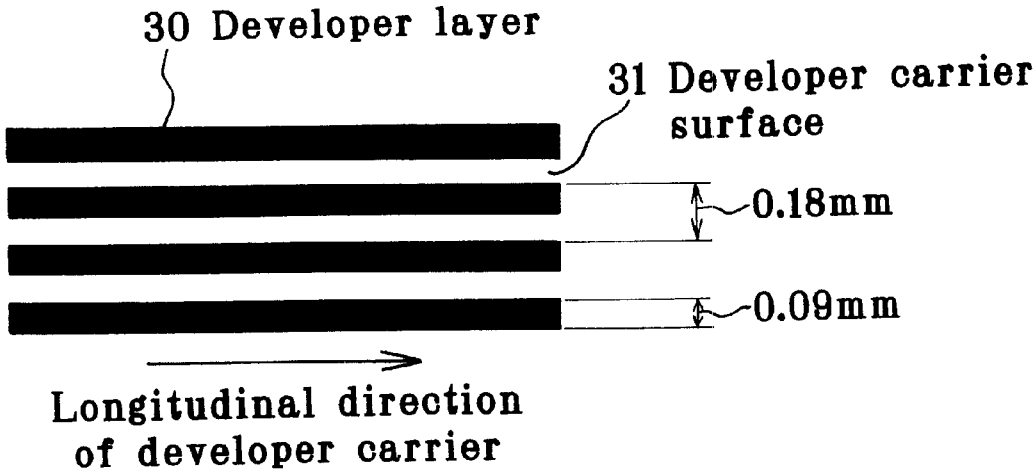
FIG. 12 is a diagram for describing a line-shaped uneven conveying surface on a developer carrier.

The following is a description of a line-shaped uneven conveying surface formed on the developer carrier of the developing device according to the present invention. FIG. 12 is a diagram for describing a line-shaped uneven conveying surface on the developer carrier. In the figure, reference numeral 30 denotes a developer layer formed on the developer carrier surface 31.

The elastic rubber provided on the distal end of the layer forming member 2 is a semiconductive rubber member having a volume resistivity of not more than $10^9$ Ωcm, preferably $10^5$ to $10^7$ Ωcm. The layer forming member 2 abuts against the metallic developer carrier 4. When an AC-superimposed bias voltage is applied to the developer carrier 4, the developer carrier 4 and the layer forming member 2 change in electric potential with no potential difference therebetween. When the electric potential is 0 V, the developer receives force to enter the area (nip) of contact between the developer carrier 4 and the layer forming member 2. Thus, the developer is allowed to pass through the nip and thus conveyed. When the electric potential is −400 V, the developer receives force acting in the direction opposite to the direction in which the developer enters the nip, and hence cannot pass through the nip. Therefore, the developer is not conveyed. Such electric potential variations provide an ON/OFF shutter action with respect to the developer. Because the ON/OFF shutter action takes place at the period of the AC bias voltage, a line-shaped uneven developer layer is formed on the conveying surface of the developer carrier.

For example, when the peak-to-peak voltage $V_{pp}$ is set at 400 V and the DC bias voltage $V_{dc}$ is set at −200 V, the bias voltage oscillates in the range of 0 V to −400 V. When the DC bias voltage $V_{dc}$ is set at 0 V, the bias voltage oscillates in the range of +200 V to −200 V. The frequency f of the AC-superimposed bias voltage may be set in correspondence to the secondary pitch frequency $f_{g2}$ of the developer carrier driving gear. The pitch frequency of the developer carrier driving gear may be calculated from the reciprocal of the period T of vibration calculated from the pitch n (millimeters) of the developer carrier driving gear and the circumferential speed m (millimeters/sec.) as follows:

$$T=n/m$$

$$f_{g1}=1/T$$

where n: gear pitch (millimeters)

m: image formation speed (millimeters/sec.)

The secondary pitch frequency $f_{g2}$ of the developer carrier driving gear is double the gear pitch frequency $f_{g1}$, which indicates the influence of banding occurring mainly when the gear shaft is decentered. The frequency of the AC-superimposed bias voltage should preferably be greater than the secondary pitch frequency, not to mention the primary pitch frequency. As an example, the secondary pitch frequency $f_{g2}$ of the developer carrier driving gear is 25.4 Hz, and the frequency f of the AC-superimposed bias voltage is 2 kHz.

The line width of the line-shaped uneven conveying surface on the developer carrier is determined by the frequency of the AC-superimposed bias voltage applied to the developer carrier and the circumferential speed of the developer carrier. Assuming that the circumferential speed of the developer carrier is 360 millimeters/sec. and the frequency of the AC-superimposed bias voltage applied to the developer carrier is 2 kHz, by way of example, lines are formed on the developer carrier in accordance with the electric potential variations such that the pitch is 0.18 millimeters and the line width is 0.09 millimeters, as shown in FIG. 12. The conveying surface formed on the developer carrier may be judged by visual observation. More objectively, lines transferred to tape are measured with a microdensitometer (available from Abe Sekkei K.K.) several times, and an average of measured MTF values is obtained. If the average MTF value is 5 or more, the line configuration can be discerned. However, it is desirable that the average MTF value be 10 or more. Simply, the MTF value may be calculated according to the following equation from a mean value $I_{on}$ of the maximum line density values and a mean value $I_{off}$ of the minimum inter-line density values obtained when five lines are measured.

$$\text{MTF value}=\{(I_{on-Ioff})/(I_{on}+I_{off})\}\times 100$$

Figure 20:
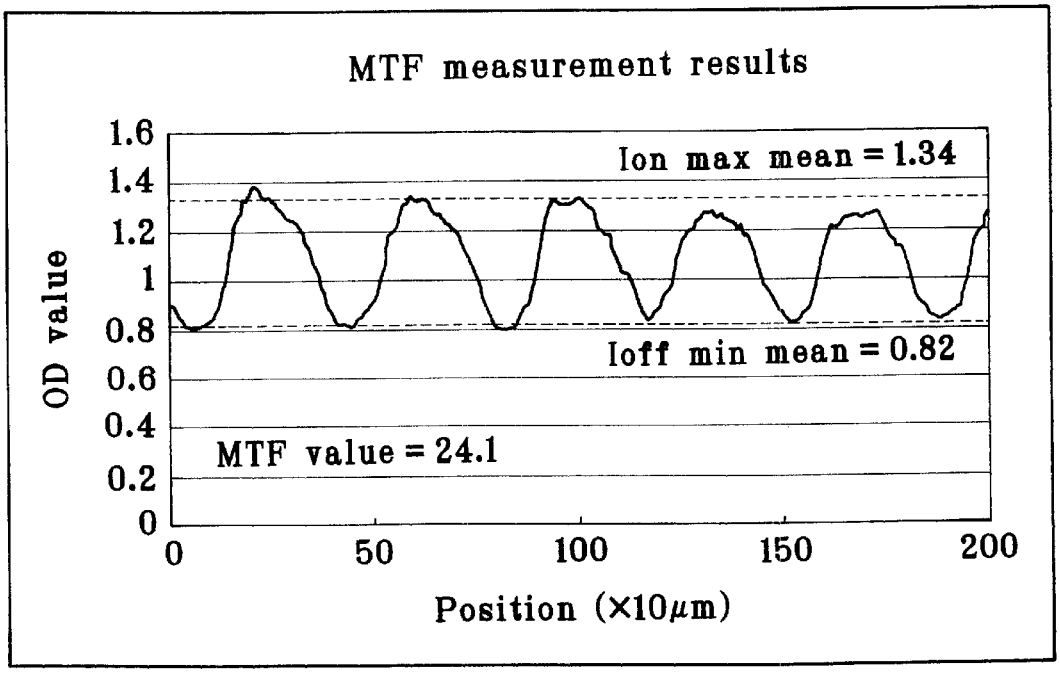
FIG. 20 is a diagram showing the results of MTF measurement performed on a line-shaped uneven conveying surface transferred to tape.

A thin developer layer was formed on the developer carrier by using the developing device according to this embodiment in such a way that the developer carrier was driven under application of the given bias voltage. As a result, a line-shaped conveying surface was formed. The line-shaped developer on the conveying surface was transferred to a piece of tape having a width of 12 millimeters with care taken not to disturb the line-shaped developer pattern. Then, the MTF value was measured with a microdensitometer. The measured MTF value was 24 as shown in FIG. 20.

The unevenness pattern pitch of the line-shaped uneven conveying surface can be controlled by the frequency design of the AC-superimposed bias voltage. The line-shaped uneven conveying surface allows stabilization of the amount of developer conveyed. That is, when the pitch of the line-shaped uneven conveying surface is set smaller than the pitch of the irregularity of feeding by the developer carrier driving gear, unevenness due to the intermittent feeding by the developer carrier driving gear is corrected so that the amount of developer conveyed is kept constant at all times. Thus, the line-shaped uneven conveying surface allows the amount of developer conveyed to become uniform and hence makes it possible to effectively reduce the occurrence of image defects known as "banding".

There is another cause of the occurrence of banding. That is, an undesired density difference appears in the image owing to a difference in the amount of developer used for development due to the irregularity of feeding of the developer carrier at the area of contact between the latent image carrier and the developer carrier. Such banding occurs when the circumferential speed varies at the time of entering the development nip even if the thickness of the conveyed developer layer is kept substantially constant. On the conveying surface when no AC bias voltage is applied to the developer carrier, the developer packing ratio (the ratio of developer to space in the development nip) is as high as 80% or more, and there is almost no freedom (space) for movement of the developer in the developer carrier feed direction. Consequently, any difference in the amount of developer used for development at the development nip results directly in an undesired density difference in the image.

In the developing device according to the present invention, line-shaped unevenness patterns are positively formed on the conveying surface by the application of an AC-superimposed bias voltage. Therefore, the developer packing ratio is at most 50%. Moreover, because there is a high degree of freedom for movement of the developer in the developer carrier feed direction, the developer can move freely forward and backward in the feed direction according to the developing bias voltage. As a result, the developer can favorably adhere to the latent image carrier surface to reproduce the electrostatic latent image faithfully. Consequently, the occurrence of banding is eliminated. Further, if an elastic photosensitive member is used as the latent image carrier, the latent image carrier is elastically deformed at the nip. As a result, the space where the developer is freely movable further increases. It is therefore possible to prevent the occurrence of banding even more effectively.

By positively forming a line-shaped uneven conveying surface as stated above, it is possible to minimize the influence of the irregularity of feeding by the driving gear and to reduce the developer packing ratio at the development nip to thereby allow an increase in the degree of freedom of movement of developer particles. By virtue of this synergistic effect, it becomes possible to eliminate the occurrence of banding substantially completely and hence possible to obtain a favorable image free from noise when it is formed by superimposing many colors on one another as in a color printer.

Further, because the conveying surface is formed with line-shaped unevenness patterns, the developer adhering to the non-image area is scraped off by the unevenness on the conveying surface, and thus fogging and scattering are reduced. The line-shaped uneven conveying surface is formed on the developer carrier with a period of unevenness patterns corresponding to the frequency of the AC-superimposed bias voltage. When the amount of developer conveyed is the same, the thickness of the developer at the projections of the line-shaped unevenness on the conveying surface is about double the developer thickness on a conventional thin-layer conveying surface. When such an uneven developer layer contacts the latent image carrier, it is easy for the developer to move according to the bias electric field at the recesses of the uneven developer layer because the developer packing ratio is low at the recesses. Accordingly, the developer adhering to the non-image area is readily separated toward the developer carrier. Meanwhile, the projections of the uneven developer layer contact the developer adhering to the non-image area at least once. At that time, the developer adhering to the non-image area is scraped off by Van der Waals force and shifts to the developer carrier. With this action, fogging and scattering can be substantially eliminated.

In addition, the present invention has the function of reducing clogging in the area between the layer forming member and the developer carrier by the developer aggregate crushing effect. The developer in the developing device is present in the form of aggregates of certain size because the developer is allowed to stand in the developing unit. Such aggregates are mechanically crushed into particles of certain size by being stirred with an agitator before being supplied to the developer carrier. When entering the nip between the layer forming member and the developer carrier, developer particles may be unable to pass therethrough, causing clogging. At a position clogged with the developer, the amount of developer conveyed reduces, resulting in developer conveyance unevenness, e.g. longitudinal strip-shaped unevenness or a longitudinal stripe. This appears as density unevenness in the developed image. Further, the developer clogging in the nip remains at that position and hence repeatedly contacts the developer carrier, causing filming on the developer carrier. However, in the present invention, an AC-superimposed bias voltage is applied to the developer carrier to vibrate the developer by electric potential variations at the first half of the nip between the layer forming member and the developer carrier, thereby crushing developer aggregates. Consequently, the developer enters the area between the developer carrier and the layer forming member in a form close to primary particles. Accordingly, developer particles readily pass through the nip between the layer forming member and the developer carrier. Alternatively, developer particles are regulated so as to flow rearward of the developing device. Therefore, clogging with the developer will not occur, and a favorable image can be obtained.

As has been stated above, the application of an AC-superimposed bias voltage causes the layer forming member and the developer carrier to vary in electric potential with no electric potential difference therebetween. When the electric potential is high or low relative to that of the developer, developer particles are allowed to pass through the nip between the layer forming member and the developer carrier, whereas when the electric potential is low or high relative to that of the developer, passage of developer particles is blocked, whereby a line-shaped uneven conveying surface is formed. When the layer forming member has electrical insulating properties ($10^{10}$ Ωcm or more in resistivity), the electric potential relative to the developer carrier becomes unstable by charge-up or the like, making it impossible to form a stable line-shaped uneven conveying surface. Therefore, it is not preferable to use a layer forming member having such electrical insulating properties.

Figure 13:
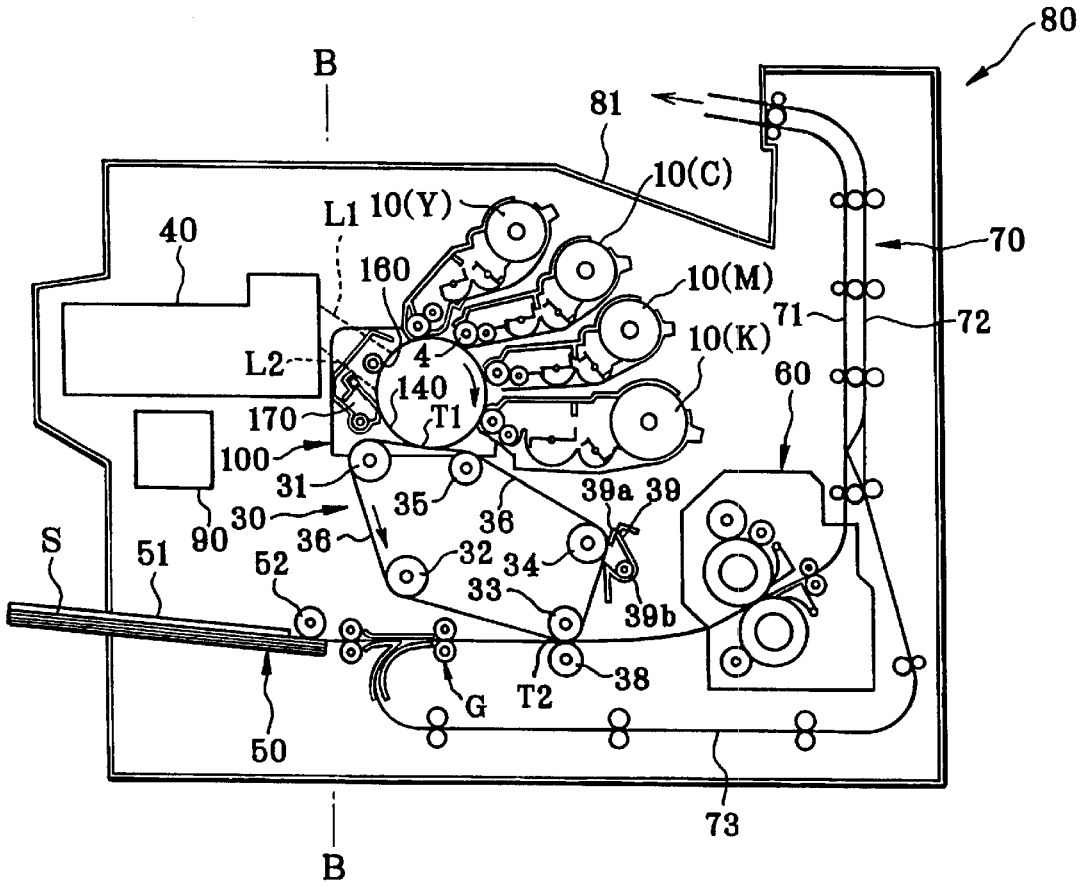
FIG. 13 is a diagram showing a structural example of an image forming apparatus equipped with the developing device according to the present invention.

Next, an image forming apparatus equipped with the developing device according to the present invention will be described. FIG. 13 is a diagram showing a structural example of an image forming apparatus B equipped with the developing device according to the present invention. The image forming apparatus B is capable of forming a full-color image by using developing units performing development with toners (developers) of four colors, i.e. yellow Y, cyan C, magenta M and black K.

In FIG. 13, an image carrier cartridge 100 has an image carrier unit incorporated therein. In this example, the image carrier cartridge 100 is constructed as a photosensitive member cartridge. A photosensitive member (latent image carrier) 140 is driven to rotate in the direction of the arrow shown in the figure by an appropriate driving device (not shown). The photosensitive member 140 has a thin-walled cylindrical electrically conductive base material and a photosensitive layer formed on the surface of the base material. A charging roller 160 as a charging device, developing units 10 (yellow Y, cyan C, magenta M, and black K) as developing devices, an intermediate transfer device 30, and a cleaning device 170 are positioned around the photosensitive member 140 in the order mentioned along the direction of rotation of the photosensitive member 140.

The charging roller 160 contacts the outer peripheral surface of the photosensitive member 140 to electrically charge the outer peripheral surface uniformly. The uniformly charged outer peripheral surface of the photosensitive member 140 is subjected to selective exposure L1 according to desired image information with an exposure unit 40. By the exposure L1, an electrostatic latent image is formed on the photosensitive member 140. The electrostatic latent image is developed with developers given by the developing units 10.

As the developing units 10, a developing unit 10Y for yellow, a developing unit 10C for cyan, a developing unit 10M for magenta and a developing unit 10K for black are provided. These developing units 10Y, 10C, 10M and 10K are swingably constructed. A developing roller (developer carrier) 4 of only one developing unit can selectively contact the photosensitive member 140. Accordingly, these developing units 10 are each arranged to apply one toner selected from yellow Y, cyan C, magenta M and black K to the surface of the photosensitive member 140 to develop the electrostatic latent image on the photosensitive member 140. The developing roller 4 is a rigid roller, e.g. a metal roller with a roughened surface. The developed toner image is transferred to an intermediate transfer belt 36 of the intermediate transfer device 30. The cleaning device 170 has a cleaner blade for scraping off toner remaining on the outer peripheral surface of the photosensitive member 140 after the transfer process. The cleaning device 170 further has a receiver for receiving toner scraped off by the cleaner blade.

The intermediate transfer device 30 has a driving roller 31, four driven rollers 32, 33, 34 and 35, and an endless intermediate transfer belt 36 stretched in such a manner as to pass around these rollers. The driving roller 31 has a gear (not shown) secured to an end thereof The gear is in mesh with a gear (not shown) for driving photosensitive member 140. Thus, the driving roller 31 is driven to rotate at approximately the same circumferential speed as that of the photosensitive member 140. Consequently, the intermediate transfer belt 36 is driven to circulate in the direction of the arrow shown in the figure at approximately the same circumferential speed as that of the photosensitive member 140.

The driven roller 35 is disposed at a position where the intermediate transfer belt 36 is pressed against the photosensitive member 140 between the driving roller 31 and the driven roller 35 by tension acting on the intermediate transfer belt 36. A primary transfer portion T1 is formed at a position where the intermediate transfer belt 36 is pressed against the photosensitive member 140. The driven roller 35 is positioned near the primary transfer portion T1 at the upstream side thereof in the direction of circulation of the intermediate transfer belt 36.

An electrode roller (not shown) is positioned to face the driving roller 31 across the intermediate transfer belt 36. A primary transfer voltage is applied to the electrically conductive layer of the intermediate transfer belt 36 through the electrode roller. The driven roller 32 is a tension roller that urges the intermediate transfer belt 36 with an urging device (not shown) in a direction in which the intermediate transfer belt 36 is stretched under tension. The driven roller 33 is a backup roller for forming a secondary transfer portion T2. A secondary transfer roller 38 is positioned to face the backup roller 33 across the intermediate transfer belt 36. A secondary transfer voltage is applied to the secondary transfer roller 38. The secondary transfer roller 38 is capable of being brought into and out of contact with the intermediate transfer belt 36 by a secondary transfer roller advancing and retracting mechanism (not shown). The driven roller 34 is a backup roller for a belt cleaner 39. The belt cleaner 39 has a cleaner blade 39*a* that is brought into contact with the intermediate transfer belt 36 to scrape off toner remaining on the outer peripheral surface of the intermediate transfer belt 36. The belt cleaner 39 further has a receiver 39*b* for receiving toner scraped off by the cleaner blade 39*a*. The belt cleaner 39 is capable of being brought into and out of contact with the intermediate transfer belt 36 by a belt cleaner advancing and retracting mechanism (not shown).

The intermediate transfer belt 36 is a double-layer belt having an electrically conductive layer and a resistance layer formed on the electrically conductive layer so as to be pressed against the photosensitive member 140. The electrically conductive layer is formed on an electrical insulating substrate made of a synthetic resin material. The primary transfer voltage is applied to the electrically conductive layer through the above-described electrode roller. It should be noted that the resistance layer is stripped longitudinally at a side edge of the intermediate transfer belt 36 to expose the electrically conductive layer in a strip-like pattern. The electrode roller contacts the exposed portion of the electrically conductive layer.

In the course of the circular movement of the intermediate transfer belt 36, the toner image on the photosensitive member 140 is transferred to the intermediate transfer belt 36 at the primary transfer portion T1. The toner image transferred to the intermediate transfer belt 36 is transferred to a sheet (recording medium) S, e.g. paper, fed between the intermediate transfer belt 36 and the secondary transfer roller 38 at the secondary transfer portion T2. The sheet S is transported from a sheet feeder 50 and fed to the secondary transfer portion T2 at a predetermined timing by a gate roller pair G. Reference numeral 51 denotes a sheet cassette. Reference numeral 52 denotes a pickup roller.

The sheet S to which the toner image has been transferred at the secondary transfer portion T2 passes through a fixing unit 60, whereby the toner image is fixed. Then, the sheet S passes through a delivery path 70 and is discharged onto a sheet delivery tray 81 formed on a casing 80 of the apparatus body. It should be noted that the image forming apparatus has two independent delivery paths 71 and 72 as the delivery path 70. The sheet S passing through the fixing unit 60 is discharged through either the delivery path 71 or 72. The delivery paths 71 and 72 also constitute a switchback path. When images are to be formed on both sides of a sheet, the sheet once entering the delivery path 71 or 72 is transported toward the secondary transfer portion T2 through a return path 73.

The following is a summary of operations taking place throughout the above-described image forming apparatus.

(1) When a print command signal (image forming signal) is inputted to a control unit 90 of the image forming apparatus from a host computer or the like (e.g. a personal computer), which is not shown in the figure, the photosensitive member 140, the roller 4 in each developing unit 10 and the intermediate transfer belt 36 are driven to rotate.

(2) The outer peripheral surface of the photosensitive member 140 is uniformly electrically charged by the charging roller 160.

(3) The uniformly charged outer peripheral surface of the photosensitive member 140 is subjected to selective exposure L1 corresponding to image information concerning a first color (e.g. yellow) with the exposure unit 40. Thus, an electrostatic latent image for yellow is formed on the photosensitive member 140.

(4) Only one developing roller for the first color, for example, the developing roller of the developing unit 10Y for yellow, comes in contact with the photosensitive member 140 to develop the above-described electrostatic latent image. Thus, a toner image of yellow as the first color is formed on the photosensitive member 140.

(5) A primary transfer voltage opposite in polarity to the charge of the toner is applied to the intermediate transfer belt 36. The toner image formed on the photosensitive member 140 is transferred to the intermediate transfer belt 36 at the primary transfer portion T1. At this time, the secondary transfer roller 38 and the belt cleaner 39 are separate from the intermediate transfer belt 36.

(6) Toner remaining on the photosensitive member 140 is removed by the cleaning device 170. Thereafter, the photosensitive member 140 is destaticized by destaticizing light L2 from a destaticizing device (not shown).

(7) The above-described operations (2) to (6) are repeated according to need. That is, according to the contents of the print command signal, the operations are repeated for a second color, a third color and a fourth color, whereby toner images corresponding to the contents of the print command signal are superimposed on one another on the intermediate transfer belt 36.

(8) A sheet S is transported from the sheet feeder 50 at a predetermined timing. Immediately before the leading end of the sheet S reaches the secondary transfer portion T2 or after it has reached the secondary transfer portion T2 (i.e. at the timing when the toner image on the intermediate transfer belt 36 is transferred to a desired position on the sheet S), the secondary transfer roller 38 is pressed against the intermediate transfer belt 36, and at the same time, a secondary transfer voltage is applied to the secondary transfer roller 38, whereby the toner image (basically, a full-color image formed from toner images of four colors superimposed on one another) on the intermediate transfer belt 36 is transferred to the sheet S. In addition, the belt cleaner 39 is brought into contact with the intermediate transfer belt 36 to remove toner remaining on the intermediate transfer belt 36 after the secondary transfer process.

(9) The sheet S passes through the fixing unit 60, thereby fixing the toner image on the sheet S. Thereafter, the sheet S is conveyed toward a predetermined position (toward the sheet delivery tray 81 in the case of single-side printing; toward the return path 73 via the switchback path 71 or 72 in the case of double-side printing).

With the above-described image forming apparatus equipped with the developing device according to the present invention, an entirely solid image and an entirely 40%-halftone image were formed. The formed images were uniform and free from density unevenness. Regarding longitudinal unevenness of density, density displacement was judged by visual observation and measurement with a densitomer (X-Rite: 404) by reference to the criterion standard that the density difference should be within 0.2. The density difference of the entirely solid image was not more than 0.1. The density difference of the entirely 40%-halftone image was not more than 0.05. Thus, the images were favorable in terms of longitudinal density unevenness. Density unevenness (banding) in the lateral direction of the images was not recognized by visual observation. Thus, the images were extremely favorable in terms of lateral density unevenness. Fogging was evaluated with the criterion standard that the amount of toner consumed when 1,000 sheets were continuously printed solid white should be not more than 2 g. With the developing device according to the present invention, the amount of toner consumed was 0.5 g per 1,000 sheets printed solid white, which is a satisfactorily low level. Further, 100,000 sheets were continuously printed to evaluate printing durability. No filming was found on the developer carrier. Even after printing 100,000 sheets, the developing device provided favorable images similar to those obtained in the early stages of printing.

FIG. 14 shows the results of an evaluation concerning the setting of an AC-superimposed bias voltage as shown in FIG. 3, which was performed by varying f, $V_{pp}$, $V_{dc}$ and the waveform under the conditions that $V_a$=−1200 V and $V_0$=−600 V were constant and the relationship of $|V_0| \geqq |V_{max}|$ was kept at all times.

In any of Examples 1 to 11, image characteristics were favorable, and there was no problem in practical use. It should be noted that Comparative Examples are as follows.

Comparative Example 1

A similar evaluation was performed by using a developing device similar to that used in Examples 1 to 11 under the conditions that $V_{pp}$ and $V_{dc}$ of the developing bias voltage applied to the developer carrier were $V_{pp}$=400 V and $V_{dc}$=−500 V and $|V_0|<|V_{max}|$. As a result, background fogging occurred in the non-image area. The developed image was unfit for practical use from the beginning of printing.

Comparative Example 2

A similar evaluation was performed by using a developing device similar to that used in Examples 1 to 11 under the conditions that $V_{pp}$ and $V_{dc}$ of the developing bias voltage applied to the developer carrier were $V_{pp}$ =800 V and $V_{dc}$=−300 V and $|V_0|<|V_{max}|$. As a result, background fogging occurred in the non-image area. The developed image was unfit for practical use from the beginning of printing.

Comparative Example 3

A similar evaluation was performed by using a developing device similar to that used in Examples 1 to 11 and applying a DC bias voltage $V_{dc}$=−300 V to the developer carrier as a developing bias voltage. As a result, background fogging occurred in the non-image area. The developed image was unfit for practical use from the beginning of printing.

FIG. 15 shows the results of an evaluation concerning the setting of an AC-superimposed bias voltage as shown in FIG. 4, which was performed by varying f, $V_{pp}$, $V_{dc}$ and the waveform under the conditions that $V_a$=−1200 V and $V_0$=−600 V were constant and the relationship of $|V_{on}| \leqq |V_{min}|$ was kept at all times.

In any of Examples 1 to 11, image characteristics were favorable, and there was no problem in practical use. It should be noted that Comparative Examples are as follows.

Comparative Example 1

A similar evaluation was performed by using a developing device similar to that used in Examples 1 to 11 under the conditions that $V_{pp}$ and $V_{dc}$ of the developing bias voltage applied to the developer carrier were $V_{pp}$=600 V and $V_{dc}$=−200 V and $|V_{on}|>|V_{min}|$. As a result, the injection of electric charge from the developer carrier to the latent image carrier occurred, causing the latent image to be destroyed. Consequently, a normal image could not be obtained. For this reason, it was impossible to perform an evaluation for the other items.

Comparative Example 2

A similar evaluation was performed by using a developing device similar to that used in Examples 1 to 11 under the conditions that $V_{pp}$ and $V_{dc}$ of the developing bias voltage applied to the developer carrier were $V_{pp}$=450 V and $V_{dc}$=−200 V and $|V_{on}|$ was slightly greater than $|V_{min}|$. As a result, no charge injection from the developer carrier to the latent image carrier occurred, but fogging due to the positively charged developer increased. Accordingly, a favorable image could not be obtained.

Comparative Example 3

A similar evaluation was performed by using a developing device similar to that used in Examples 1 to 11 and applying a DC bias voltage $V_{dc}$=−300 V to the developer carrier as a developing bias voltage. As a result, background fogging occurred in the non-image area. The developed image was unfit for practical use from the beginning of printing.

FIG. 16 shows the results of an evaluation concerning the setting of an AC-superimposed bias voltage as shown in FIG. 5, which was performed by varying f, $V_{pp}$, $V_{dc}$ and the waveform under the conditions that $V_a$=−1200 V and $V_0$=−600 V were constant and the relationships of $|V_0| \geqq |V_{max}|$ and $|V_{on}| \leqq |V_{min}|$ were kept at all times, or $V_{max}$ and $V_{min}$ were set so as to be identical in polarity with each other.

In any of Examples 1 to 11, image characteristics were favorable, and there was no problem in practical use. It should be noted that Comparative Examples are as follows.

Comparative Example 1

A similar evaluation was performed by using a developing device similar to that used in Examples 1 to 11 under the conditions that $V_{pp}$ and $V_{dc}$ of the developing bias voltage applied to the developer carrier were $V_{pp}$=400 V and $V_{dc}$=−500 V and $|V_0|<|V_{max}|$. As a result, background fogging occurred in the non-image area. The developed image was unfit for practical use from the beginning of printing.

Comparative Example 2

A similar evaluation was performed by using a developing device similar to that used in Examples 1 to 11 under the conditions that $V_{pp}$ and $V_{dc}$ of the developing bias voltage applied to the developer carrier were $V_{pp}$=600 V and $V_{dc}$=−200 V and $|V_{on}|>|V_{min}|$. As a result, the injection of electric charge from the developer carrier to the latent image carrier occurred, causing the latent image to be destroyed. Consequently, a normal image could not be obtained. For this reason, it was impossible to perform an evaluation for the other items.

Comparative Example 3

A similar evaluation was performed by using a developing device similar to that used in Examples 1 to 11 under the conditions that $V_{pp}$ and $V_{dc}$ of the developing bias voltage applied to the developer carrier were $V_{pp}$=450 V and $V_{dc}$=−200 V and $|V_{on}|$ was slightly greater than $|V_{min}|$. As a result, no charge injection from the developer carrier to the latent image carrier occurred, but fogging due to the positively charged developer increased. Accordingly, a favorable image could not be obtained.

Comparative Example 4

A similar evaluation was performed by using a developing device similar to that used in Examples 1 to 11 and applying a DC bias voltage $V_{dc}$=−300 V to the developer carrier as a developing bias voltage. As a result, background fogging occurred in the non-image area. The developed image was unfit for practical use from the beginning of printing.

FIG. 17 shows the results of an evaluation concerning the setting of an AC-superimposed bias voltage as shown in FIG. 6, which was performed by varying f, $V_{pp}$, $V_{dc}$ and the waveform under the conditions that $V_a$=−1200 V, $V_0$=−600 V and $V_{on}$=−30 V were constant and the relationships of $|V_0-V_{on}| \geqq |V_{pp}|$ and $|V_{dc}| \leqq |V_0-V_{on}|/2$ were kept at all times.

In any of Examples 1 to 11, image characteristics were favorable, and there was no problem in practical use. It should be noted that Comparative Examples are as follows.

Comparative Example 1

A similar evaluation was performed by using a developing device similar to that used in Examples 1 to 11 under the conditions that $V_{pp}$ and $V_{dc}$ of the developing bias voltage applied to the developer carrier were $V_{pp}$=700 V and $V_{dc}$=−300 V and $|V_0|<|V_{max}|$. As a result, background fogging occurred in the non-image area. The developed image was unfit for practical use from the beginning of printing.

Comparative Example 2

A similar evaluation was performed by using a developing device similar to that used in Examples 1 to 11 under the conditions that $V_{pp}$ and $V_{dc}$ of the developing bias voltage applied to the developer carrier were $V_{pp}$=570 V and $V_{dc}$=−350 V and $|V_{dc}|>|V_0-V_{on}|/2$. As a result, background fogging occurred in the non-image area. The developed image was unfit for practical use from the beginning of printing.

Comparative Example 3

A similar evaluation was performed by using a developing device similar to that used in Examples 1 to 11 and applying a DC bias voltage $V_{dc}$=−300 V to the developer carrier as a developing bias voltage. As a result, background fogging occurred in the non-image area. The developed image was unfit for practical use from the beginning of printing.

It should be noted that the present invention is not necessarily limited to the foregoing embodiments but can be modified in a variety of ways. For example, in the foregoing embodiments, the maximum value $V_{max}$ of the AC-superimposed bias voltage is set on the basis of the charge potential $V_0$, which is the surface potential of the non-image area on the latent image carrier, and the minimum value $V_{min}$ of the AC-superimposed bias voltage is set on the basis of the exposure potential $V_{on}$, which is the surface potential of the image area on the latent image carrier. However, the maximum value $V_{max}$ and the minimum value $V_{min}$ of the AC-superimposed bias voltage may be set on the basis of the point at which the development γ rises with respect to the surface potential of the latent image carrier.

More specifically, the threshold value $V_{th}$ at which the developer actually begins to adhere is not necessarily coincident with the surface potential $V_0$ or $V_{on}$, as has already been stated in connection with FIG. 8. For example, a threshold value $V_{th}$ is obtained in accordance with each of various working conditions and environments of the apparatus, and to eliminate fogging in the non-image area, the maximum value $V_{max}$ of the AC-superimposed bias voltage is set lower than the point at which the development γ rises with respect to the charge potential $V_0$ of the latent image carrier, i.e. the threshold value $V_{th0}$, and the minimum value $V_{min}$ of the AC-superimposed bias voltage is set higher than the threshold value $V_{thon}$ of the development γ with respect to the exposure potential $V_{on}$ of the latent image carrier. The surface potentials $V_0$ and $V_{on}$ may be replaced with the corresponding threshold values $V_{th0}$ and $V_{thon}$, respectively.

Further, in the foregoing embodiments, the maximum and minimum values of the AC-superimposed bias voltage are regulated in a fixed relationship to the charge and exposure potentials of the latent image carrier. However, the maximum and minimum values of the AC-superimposed bias voltage may be regulated in relation to the rising point $V_{th}$ of the development γ in place of the charge and exposure potentials of the latent image carrier. The present invention is, needless to say, similarly applicable to a system in which the maximum and minimum values of the AC-superimposed bias voltage are not particularly regulated in relation to these potential values.

As will be clear from the foregoing description, according to the present invention, the maximum value of the AC-superimposed bias voltage to be applied to the developer carrier is set lower than the charge potential of the latent image carrier, and the minimum value of the AC-superimposed bias voltage is set higher than the exposure potential of the latent image carrier. Alternatively, the maximum and minimum values of the AC-superimposed bias voltage are set so as to be identical in polarity with each other, and the maximum value of the AC-superimposed bias voltage is set lower than the charge potential of the latent image carrier. By setting the maximum and minimum values of the AC-superimposed bias voltage in this way, it is possible to prevent the developer from adhering to the non-image area.

The DC bias voltage is set lower than the middle between the charge and exposure potentials of the latent image carrier, and the minimum value of the AC-superimposed bias voltage is set lower than the exposure potential of the latent image carrier, whereby an appropriate development γ can be set.

Further, it becomes possible to form a uniform image free from density unevenness.

An appropriate development γ can be set by setting the charge potential $V_0$ and exposure potential $V_{on}$ of the latent image carrier and the peak-to-peak voltage $V_{pp}$ of the AC-superimposed bias voltage, together with the DC bias voltage $V_{dc}$, so as to satisfy the following conditions:

$$|V_0-V_{on}|\geq|V_{pp}|$$

$$|V_{dc}|\leq|V_0-V_{on}|/2$$

With the present invention, it is possible to prevent the developer from adhering to the non-image area and to set an appropriate development γ and hence possible to prevent the occurrence of fogging and blur due to disconnection, thickening or scattering of thin lines of the image and to form a uniform image free from density unevenness.

In addition, the present invention provides a developing device in which a developer on a developer carrier is allowed to adhere to a latent image carrier to form an image under application of an AC-superimposed bias voltage to the developer carrier. With the present invention, a constant-current bias is applied to a developer supply member to supply a constant current between the supply member and the developer carrier in such a manner as to follow the AC-superimposed bias voltage. Accordingly, the bias will not become an inverted electric potential that acts in a direction in which the developer separates from the developer carrier toward the supply member. Thus, the developer can be stably supplied to the developer carrier, and favorable images can be formed over a long period of time even if the thickness of the developer layer is reduced.

The developer carrier 4 and the developer will be further described in detail. In the following description, the developing device is of the contact development type in which the developer carrier 4 is brought into contact with the latent image carrier 1. The peripheral speed of the developer carrier 4 is set higher than the circumferential speed of the latent image carrier 1 (circumferential speed ratio=the circumferential speed of the developer carrier 4/the circumferential speed of the latent image carrier 1>1). The supply member 3 having a surface made of an elastic electrically conductive or insulating material is placed in contact with the developer carrier 4. In addition, the supply member 3 is pressed against the developer carrier 4 at all times while being driven to rotate with a predetermined circumferential speed ratio.

Figure 18:
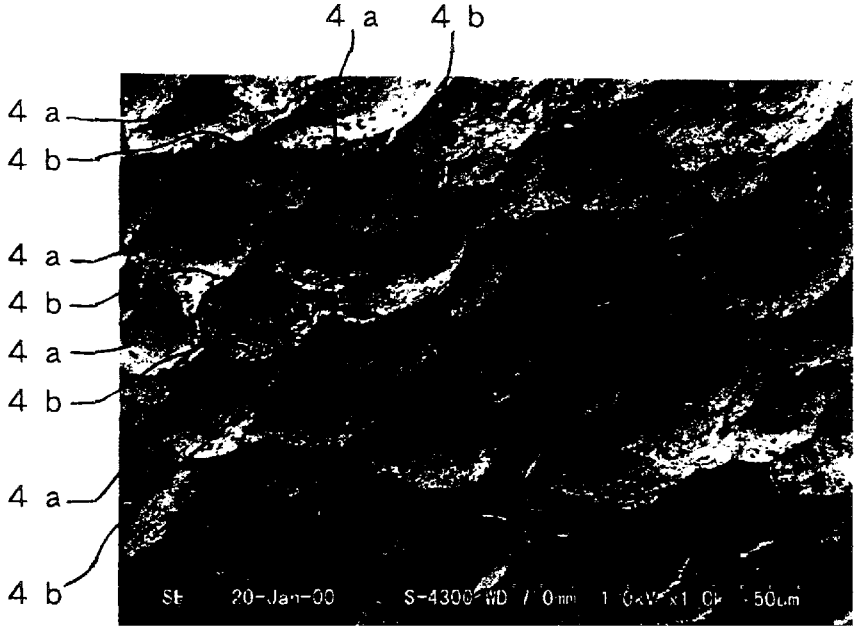
FIG. 18 is a micrograph showing a dimpled surface formed on a developer carrier by sandblasting.

The developer carrier 4 is a metal roller made of aluminum. At least a developer carrier region (toner conveying region) of the surface of the metal roller is subjected to sandblasting treatment to form a dimpled surface. As shown in FIG. 18, the dimpled surface has clear projections. That is, the edges 4*b* at the boundaries between the adjacent recesses 4*a* are clearly defined.

The sandblasted portion of the metal roller is further subjected to aluminum anodizing treatment. When the surface of the metal roller is subjected to aluminum anodizing treatment, the electrolytic reaction is allowed to penetrate to the inside of the metal roller. Therefore, a relatively thin oxide layer is formed on the surface of the metal roller. The oxide layer has a predetermined electrical resistance and a predetermined hardness. Thus, the aluminum roller, which has an extremely small electrical resistance, is provided with a surface exhibiting a predetermined electrical resistance and a predetermined hardness. If the aluminum anodizing treatment is carried out slowly with an electrolytic aqueous solution kept at a relatively low temperature, the surface of the developer carrier 4 can be made harder.

Figure 19:
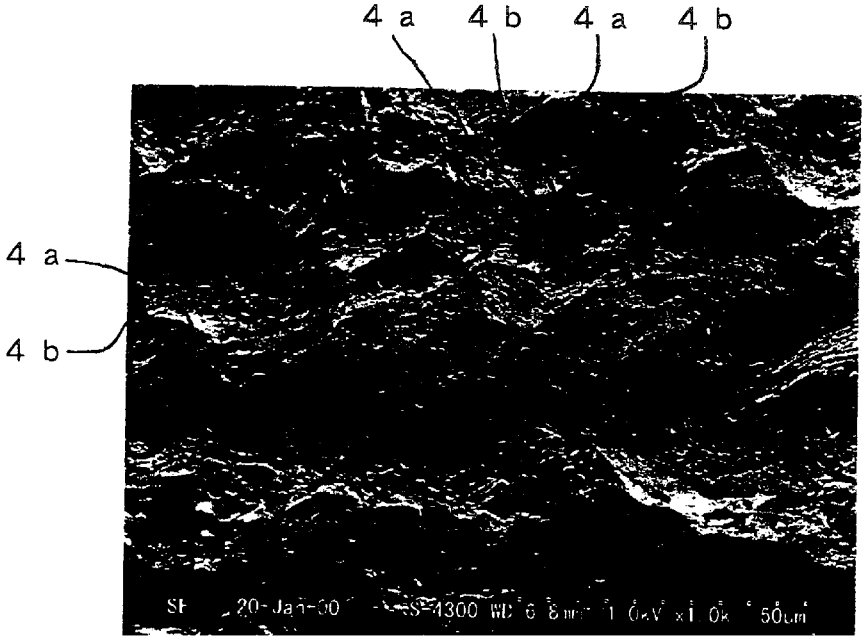
FIG. 19 is a micrograph showing the dimpled surface on the developer carrier after aluminum anodizing treatment.

Although the surface of the metal roller has an oxide layer formed thereon by aluminum anodizing treatment as stated above, the sandblasted dimpled surface is not impaired by the oxide layer because the oxide layer is extremely thin. Accordingly, as shown in FIG. 19, there is substantially no change in the dimple configuration of the surface of the metal roller after the aluminum anodizing treatment. Thus, the dimple configuration of the sandblasted surface is substantially retained.

It should be noted that the oxide layer is a porous layer with a large number of pores. Therefore, a pore sealing treatment for sealing the large number of pores is carried out to inactivate the porous layer. In this way, the surface of the metal roller is treated so that foreign matter is unlikely to adhere to the surface of the metal roller and the roller surface is not readily corroded. Thus, environmental stability is improved.

Further, in the developing device according to this embodiment, a developing bias voltage is applied to the developer carrier 4 as shown in FIG. 2 in the same way as in the conventional developing device. In the developing device of this embodiment, an AC-superimposed bias voltage formed by superimposing the direct current from the DC bias source 5 and the alternating current from the AC bias source 6 on one another is applied to the developer carrier 4 as a developing bias voltage. For example, when the electric potential at the image area on the latent image carrier 1 is set at $V_{on}$ (ground potential, i.e. 0 V, in the illustrated example) and the electric potential at the non-image area on the latent image carrier 1 is set at $V_0$ (a negative voltage in the illustrated example), as shown in FIG. 5, the maximum value $V_{max}$ of the developing bias voltage $V_{dc}$ applied to the developer carrier 4 is set equal to the electric potential $V_{on}$ at the image area, and the minimum value $V_{min}$ thereof is set greater than the electric potential $V_0$ at the non-image area. In other words, the developing bias voltage $V_{dc}$ is set at a predetermined value closer to the electric potential $V_{on}$ at the image area than the electric potential $V_0$ at the non-image area; it is not set on the side of the non-image area electric potential $V_0$ remote from the image area electric potential $V_{on}$. Thus, the particles of the developer on the developer carrier 4 are prevented from adhering to the non-image area on the latent image carrier 1 even more effectively.

Furthermore, the developer 7 used in the developing device according to this embodiment is formed as a non-magnetic one-component toner by externally adding relatively hard silica to toner matrix particles made of a relatively soft polyester resin material. In this case, the hardness of the surface of the developer carrier 4 is set lower than the hardness of the external additive (silica) of the developer 7. More specifically, the hardness of the surface of the developer carrier 4 is set with respect to the hardness of the external additive of the developer 7 such that the dimples on the surface of the developer carrier 4 may be somewhat shaved but not excessively.

Moreover, the sphericity of the particles of the developer 7 is set in the range of 0.9 to 1 in terms of Wadell's practical sphericity so that the developer 7 is suitable for faithfully developing a high-definition latent image on the latent image carrier 1 to a visible image. The Wadell's practical sphericity of the developer 7 is a numerical value expressed in the form of the ratio of the diameter of a circle having an area equal to the projected area of a toner particle in a projected image thereof to the diameter of a minimum circle circumscribing the projected image of the particle.

The reason why the above-described sphericity of the developer 7 is suitable for faithfully developing a high-definition latent image to a visible image is disclosed in Japanese Patent Application Unexamined Publication (KOKAI) No. Hei 9-311544, which was proposed by the present inventor and has already been filed by the present applicant. Therefore, the reason is readily understandable on referring to the laid-open publication. Let us brief the reason. The sphericity of the developer 7 is set in the range of 0.9 to 1 in terms of Wadell's practical sphericity, thereby approximating the particles of the developer 7 to spheres. Consequently, when the developer 7 on the developer carrier 4 adheres to the latent image carrier 1 according to the electric potential in a development operation, the particles of the developer 7 can readily form a densely packed layer on the latent image carrier 1, thereby faithfully and clearly reproducing the contours of the details of the latent image.

The Wadell's practical sphericity can be measured by using an image processing apparatus with an optical microscope (available from Abionics). The sphericity measuring procedure is described in the above-mentioned Japanese Patent Application Unexamined Publication (KOKAI) No. Hei 9-311544 and readily understandable on referring to the laid-open publication. Therefore, a description of the sphericity measuring procedure is omitted.

In the developing device according to this embodiment, arranged as stated above, the developer 7 supplied from the supply member 3 to the surface of the developer carrier 4 is conveyed toward the layer forming member 2 by the developer carrier 4 rotating counterclockwise in FIG. 2. The developer 7 reaching the layer forming member 2 is regulated by the layer forming member 2 so that a predetermined amount of developer 7 is conveyed toward the latent image carrier 1. An excess of developer 7 is returned toward the supply member 3. The developer 7 passing under the layer forming member 2 forms a thin developer layer with a predetermined thickness on the developer carrier 4. The developer 7 formed into a thin layer is conveyed toward the latent image carrier 1 by the developer carrier 4. With the developer 7, the electrostatic latent image on the latent image carrier 1 is developed to form a toner image on the latent image carrier 1.

With the developing device according to this embodiment, the dimple configuration of the sandblasted surface of the developer carrier 4 can be substantially retained after the aluminum anodizing treatment. In other words, the dimple configuration of the sandblasted surface of the developer carrier 4 can keep the clearly defined edges after the aluminum anodizing treatment. Accordingly, the developer 7 can be conveyed even more reliably by the edge effect of the dimpled surface of the developer carrier 4. Thus, it is possible to improve the performance of conveying the developer 7.

Further, because the edges of the dimple configuration of the sandblasted surface are retained, it is possible to increase the area of contact between the dimpled surface of the developer carrier 4 and the particles of the developer 7. Consequently, the particles of the developer 7 can be satisfactorily rubbed with the developer carrier 4 and thus frictionally charged effectively. Accordingly, the chargeability of the developer 7 can be improved.

Further, because the surface of the developer carrier 4 is made hard with the oxide layer formed by the aluminum anodizing treatment, the developer carrier 4 can be improved in both wear resistance and mechanical strength.

Furthermore, because the surface of the aluminum roller, which has a relatively small electrical resistance, is provided with an electrical resistance layer comprising an oxide layer formed by aluminum anodizing treatment, a predetermined electrical resistance can be imparted to the metal roller. Because the surface of the metal roller can be uniformly subjected to aluminum anodizing treatment, the electrical resistance can be obtained over the whole surface of the anodized aluminum portion of the metal roller even more uniformly. Accordingly, it is unnecessary to use a special material having a predetermined electrical resistance in advance as a material for the developer carrier 4. Therefore, the developer carrier 4 can be formed easily at reduced costs from a metal having a predetermined uniform electrical resistance.

Further, because the developer carrier 4 has a predetermined uniform electrical resistance, it is possible to prevent excessive charge injection into the developer 7 by the developing bias voltage. In a contact development type developing device in which the developer carrier 4 contacts the latent image carrier 1 as in this embodiment, in particular, an increased pressure is applied to the particles of the developer 7 pressed between the latent image carrier 1 and the developer carrier 4. When the pressure applied to the developer particles is increased, excessive charge injection into the developer 7 is promoted. Such excessive charge injection into the developer 7 can be effectively prevented by the uniform electrical resistance.

Thus, the above-described three functions can be imparted to the developer carrier 4 even more surely in the developing device according to this embodiment. Accordingly, the developing device can provide high-quality images free from image defects, e.g. density unevenness, over a long period of time.

Further, because a developing bias voltage formed by superimposing an alternating current on a direct current is applied to the developer carrier 4, discharge of the developing bias voltage from the developer carrier 4 can be prevented by appropriately controlling the developing bias voltage. In particular, because the maximum potential of the developing bias voltage is set lower than the electric potential set for the non-image area on the latent image carrier, it is possible to prevent discharge of the developing bias voltage even more effectively and to suppress adhesion of the toner to the non-image area on the latent image carrier and hence possible to prevent toner fogging.

Moreover, a moderate edge effect can be given to the image by superimposing an alternating current on a direct current. In addition, the middle tones of the image can be reproduced uniformly. Thus, gradation characteristics can be improved.

Further, because the hardness of the surface of the developer carrier 4 is set lower than the hardness of the external additive of the developer 7, the dimpled surface of the developer carrier 4 is slightly shaved or chipped by rubbing with the external additive of the developer 7. Accordingly, the developer 7 adhering to the developer carrier 4 can be surely scraped off. Thus, adhesion of the developer 7 to the developer carrier 4 can be suppressed to prevent filming on the developer carrier 4. In addition, because the dimpled surface of the developer carrier 4 is slightly chipped, new edges can be formed on the dimpled surface.

Further, because the circumferential speed of the developer carrier 4 is set higher than the circumferential speed of the latent image carrier 1, the particles of the developer 7 roll and rub against the developer carrier 4 owing to the speed difference at a development area where the developer carrier 4 contacts the latent image carrier 1, thereby allowing the developer 7 to be effectively recharged. Thus, it is possible to increase the charge quantity of the toner having a small charge quantity. Consequently, the toner adhering to the non-image area on the latent image carrier 1 can be surely recovered to the developer carrier 4. In the image area on the latent image carrier 1, the developer 7 can be surely made to adhere to positions. where it should adhere. Thus, it becomes possible to prevent adhesion of the developer 7 to positions displaced from the desired locations, which would otherwise blur the image.

Moreover, the sphericity of the developer 7 is set in the range of 0.9 to 1 in terms of Wadell's practical sphericity, thereby making the developer particles close to spheres. Therefore, the particles of the developer 7 are allowed to roll and rub against the developer carrier 4 even more surely. Accordingly, it becomes possible to recharge the developer 7 even more effectively. Thus, the developer 7 adhering to the non-image area on the latent image carrier 1 can be surely recovered to the developer carrier 4, and it is possible to prevent the image from becoming blurred at the image area on the latent image carrier 1, as in the case of the above. Further, a high-definition latent image on the latent image carrier 1 can be faithfully developed to a visible image.

As will be clear from the foregoing description, the developing device according to the present invention provides advantageous effects as follows.

The dimple configuration of the sandblasted surface of the developer carrier can be substantially retained after the aluminum anodizing treatment. That is, the dimple configuration of the sandblasted surface of the developer carrier can keep the clearly defined edges after the aluminum anodizing treatment. Accordingly, the developer can be conveyed even more reliably by the edge effect of the dimpled surface of the developer carrier. Thus, it is possible to improve the performance of conveying the developer.

Further, because the edges of the dimple configuration of the sandblasted surface are retained, it is possible to increase the area of contact between the dimpled surface of the developer carrier and the particles of the developer. Consequently, the particles of the developer can be satisfactorily rubbed with the developer carrier and thus frictionally charged effectively. Accordingly, the chargeability of the developer can be improved.

Further, because the surface of the developer carrier is made hard with the oxide layer formed by the aluminum anodizing treatment, the developer carrier can be improved in both wear resistance and mechanical strength.

Furthermore, because the surface of the aluminum roller, which has a relatively small electrical resistance, is provided with an electrical resistance layer comprising an oxide layer formed by aluminum anodizing treatment, a predetermined electrical resistance can be imparted to the metal roller. Because the surface of the metal roller can be uniformly subjected to aluminum anodizing treatment, the electrical resistance can be obtained over the whole surface of the anodized aluminum portion of the metal roller even more uniformly. Accordingly, it is unnecessary to use a special material having a predetermined electrical resistance in advance as a material for the developer carrier. Therefore, the developer carrier can be formed easily at reduced costs from a metal having a predetermined uniform electrical resistance.

In particular, the electrical resistance layer formed on the surface of the developer carrier by aluminum anodizing treatment makes it possible to effectively prevent discharge of the developing bias voltage from the developer carrier to the latent image carrier when the developing bias voltage is applied to the developer carrier even if the developer carrier is in contact with the latent image carrier.

Further, because a developing bias voltage formed by superimposing an alternating current on a direct current is applied to the developer carrier, discharge of the developing bias voltage from the developer carrier can be prevented by appropriately controlling the developing bias voltage. In particular, because the potential of the developing bias voltage is set closer to the electric potential set for the image area on the latent image carrier than the electric potential set for the non-image area on the latent image carrier, it is possible to prevent discharge of the developing bias voltage from the developer carrier to the latent image carrier even more effectively and to suppress adhesion of the developer to the non-image area on the latent image carrier and hence possible to prevent fogging with the developer.

Further, because the developer carrier has a predetermined uniform electrical resistance, it is possible to prevent excessive charge injection into the developer by the developing bias voltage. In a contact development type developing device in which the developer carrier contacts the latent image carrier as in the present invention, in particular, an increased pressure is applied to the particles of the developer pressed between the latent image carrier and the developer carrier. When the pressure applied to the developer particles is increased, excessive charge injection into the developer is promoted. Such excessive charge injection into the developer can be effectively prevented by the uniform electrical resistance.

Thus, the above-described three functions can be imparted to the developer carrier even more surely in the developing device according to the present invention. Therefore, the developing device according to the present invention can provide high-quality images free from image defects, e.g. density unevenness, over a long period of time.

Further, a moderate edge effect can be given to the image by superimposing an alternating current on a direct current. In addition, the middle tones of the image can be reproduced uniformly. Thus, gradation characteristics can be improved.

Further, because the hardness of the surface of the developer carrier is set lower than the hardness of the external additive of the toner, the dimpled surface of the developer carrier is slightly shaved or chipped by rubbing with the external additive of the toner. Accordingly, adhesion of the toner to the developer carrier can be suppressed to prevent filming on the developer carrier. In addition, because the dimpled surface of the developer carrier is slightly chipped, new edges can be formed on the dimpled surface.

Further, in the developing device according to the present invention, the circumferential speed of the developer carrier is set higher than the circumferential speed of the latent image carrier. Therefore, the particles of the developer roll and rub against the developer carrier owing to the speed difference at a development area where the developer carrier contacts the latent image carrier, thereby allowing the toner to be effectively recharged. Thus, it is possible to increase the charge quantity of the toner having a small charge quantity. Consequently, the toner adhering to the non-image area on the latent image carrier can be surely recovered to the developer carrier. In the image area on the latent image carrier, the developer can be surely made to adhere to positions where it should adhere. Thus, it becomes possible to prevent adhesion of the developer to positions displaced from the desired locations, which would otherwise blur the image.

Moreover, the sphericity of the developer particles is set in the range of 0.9 to 1 in terms of Wadell's practical sphericity. Therefore, the particles of the developer are allowed to roll and rub against the developer carrier even more surely. Accordingly, it becomes possible to recharge the developer even more effectively. Thus, the developer adhering to the non-image area on the latent image carrier can be surely recovered to the developer carrier, and it is possible to prevent the image from becoming blurred at the image area on the latent image carrier, as in the case of the above. Further, a high-definition latent image on the latent image carrier can be faithfully developed to a visible image.

What we claim is:

1. A developing device comprising:

a developer carrier for carrying a developer;

a supply member disposed to rotate in contact with said developer carrier to supply a developer layer having a predetermined thickness to a surface of said developer carrier;

a layer forming member disposed to abut against said developer carrier to regulate a layer thickness of said developer so as to form a thin developer layer on said developer carrier; and bias application means for applying an AC-superimposed bias voltage to said developer carrier, said AC-superimposed bias voltage being formed by superimposing an alternating current on a DC bias voltage, thereby developing a latent image on a latent image carrier with the thin developer layer formed on said developer carrier by said layer forming member;

wherein said bias application means sets a maximum value of said AC-superimposed bias voltage lower than a charge potential of said latent image carrier.

2. A developing device according to claim 1, wherein said bias application means sets said DC bias voltage lower than a middle potential between the charge potential of said latent image carrier and an exposure potential thereof.

3. A developing device according to claim 1, wherein said bias application means sets a minimum value of said AC-superimposed bias voltage lower than an exposure potential of said latent image carrier.

4. A developing device according to claim 1, wherein said bias application means sets maximum and minimum values of said AC-superimposed bias voltage identical in polarity with each other.

5. A developing device according to claim 1, wherein said developer carrier is in contact with said latent image carrier.

6. A developing device comprising:

a developer carrier for carrying a developer;

a supply member disposed to rotate in contact with said developer carrier to supply a developer layer having a predetermined thickness to a surface of said developer carrier;

a layer forming member disposed to abut against said developer carrier to regulate a layer thickness of said developer so as to form a thin developer layer on said developer carrier; and bias application means for applying an AC-superimposed bias voltage to said developer carrier, said AC-superimposed bias voltage being formed by superimposing an alternating current on a DC bias voltage, thereby developing a latent image on a latent image carrier with the thin developer layer formed on said developer carrier by said layer forming member;

wherein said bias application means sets a minimum value of said AC-superimposed bias voltage higher than an exposure potential of said latent image carrier.

7. A developing device according to claim 6, wherein said bias application means sets maximum and minimum values of said AC-superimposed bias voltage identical in polarity with each other.

8. A developing device according to claim 6, wherein said bias application means sets a maximum value of said AC-superimposed bias voltage lower than a charge potential of said latent image carrier.

9. A developing device according to claim 6, wherein said bias application means sets a maximum value of said AC-superimposed bias voltage higher than a charge potential of said latent image carrier.

10. A developing device according to claim 6, wherein said developer carrier is in contact with said latent image carrier.

11. A developing device comprising:

a developer carrier for carrying a developer;

a supply member disposed to rotate in contact with said developer carrier to supply a developer layer having a predetermined thickness to a surface of said developer carrier;

a layer forming member disposed to abut against said developer carrier to regulate a layer thickness of said developer so as to form a thin developer layer on said developer carrier; and bias application means for applying an AC-superimposed bias voltage to said developer carrier, said AC-superimposed bias voltage being formed by superimposing an alternating current on a DC bias voltage, thereby developing a latent image on a latent image carrier with the thin developer layer formed on said developer carrier by said layer forming member;

wherein said bias application means sets said AC-superimposed bias voltage so that a charge potential $V_0$ and an exposure potential $V_{on}$ of said latent image carrier, a peak-to-peak voltage $V_{pp}$ of said AC-superimposed bias voltage and said DC bias voltage $V_{dc}$ satisfy the following conditions:

$$|V_0-V_{on}|\geqq|V_{pp}|$$

$$|V_{dc}|\leqq|V_0-V_{on}|/2$$

12. A developing device according to claim 11, wherein said developer carrier is in contact with said latent image carrier.

13. A developing device comprising:

a developer carrier for carrying a developer;

a supply member disposed to rotate in contact with said developer carrier to supply a developer layer having a predetermined thickness to a surface of said developer carrier;

a layer forming member disposed to abut against said developer carrier to regulate a layer thickness of said developer so as to form a thin developer layer on said developer carrier; and bias application means for applying an AC-superimposed bias voltage to said developer carrier, said AC-superimposed bias voltage being formed by superimposing an alternating current on a DC bias voltage, thereby developing a latent image on a latent image carrier with the thin developer layer formed on said developer carrier by said layer forming member;

wherein said bias application means has a constant-current bias source for applying a constant-current bias voltage to said supply member to supply a constant current between said supply member and said developer carrier in such a manner as to follow said AC-superimposed bias voltage.

14. A developing device according to claim 13, wherein said bias application means comprises:

an AC-superimposed bias source for applying said AC-superimposed bias voltage to said developer carrier; and said constant-current bias source for applying said constant-current bias voltage to said supply member, said constant-current bias source having sufficiently high responsivity to follow said AC-superimposed bias voltage.

15. A developing device according to claim 13, wherein said constant-current bias source is connected directly between said developer carrier and said supply member.

16. A developing device according to claim 13, wherein said constant-current bias source follows said AC-superimposed bias voltage with a peak-to-peak voltage at least 0.5 times a peak-to-peak voltage of said AC-superimposed bias voltage.

* * * * *